US009562353B2

(12) United States Patent
Bettiol et al.

(10) Patent No.: US 9,562,353 B2
(45) **Date of Patent: *Feb. 7, 2017**

(54) BUILDING ENVELOPE MEMBER WITH INTERNAL WATER RESERVOIR

(71) Applicants: Michael Bettiol, Binbrook, Ontario (CA); Richard George Weatherston, Stoney Creek, Ontario (CA); Alan Shaidle, Hudson, OH (US)

(72) Inventors: Michael Bettiol, Binbrook (CA); Richard George Weatherston, Stoney Creek (CA); Alan Shaidle, Hudson, OH (US)

( * ) Notice: Subject to any disclaimer, the term of this patent is extended or adjusted under 35 U.S.C. 154(b) by 86 days.

This patent is subject to a terminal disclaimer.

(21) Appl. No.: 14/611,272

(22) Filed: Feb. 1, 2015

(65) Prior Publication Data

US 2015/0143757 A1 May 28, 2015

Related U.S. Application Data

(63) Continuation of application No. 13/581,644, filed as application No. PCT/CA2011/000237 on Mar. 4, 2011, now Pat. No. 8,973,313.

(Continued)

(51) Int. Cl.
*E04B 7/18* (2006.01)
*E04D 13/04* (2006.01)

(Continued)

(52) U.S. Cl.
CPC . *E04B 7/18* (2013.01); *E03B 1/04* (2013.01); *E04B 1/12* (2013.01); *E04B 1/34321* (2013.01);

(Continued)

(58) Field of Classification Search
CPC ..... E03B 1/04; E03B 3/03; E04B 1/12; E04B 1/34321; E04B 2001/949

(Continued)

(56) References Cited

U.S. PATENT DOCUMENTS 3,481,093 A * 12/1969 Davidson ..... 52/293.1
3,616,583 A * 11/1971 Weineck et al. ..... 52/168

(Continued)

FOREIGN PATENT DOCUMENTS

DE 3537163 8/1986
DE 19751590 4/1999

(Continued)

OTHER PUBLICATIONS

International Preliminary Report on Patentability for PCT/CA2011/000237 dated Sep. 4, 2012 (7 pages).

*Primary Examiner* — Rodney Mintz
(74) *Attorney, Agent, or Firm* — Steven M. Greenberg; CRGO Law

(57) ABSTRACT

Buildings which include rudimentary plumbing can be transported as a set of disassembled modular parts and then assembled on site. The assembled building includes a water reservoir in the roof and a sewage reservoir in the base, so as to enable gravity-based water supply and sewage disposal in the absence of traditional plumbing and sewage infrastructure. Building envelope elements having internal reservoirs, and methods for constructing such building envelope elements are also described.

4 Claims, 22 Drawing Sheets

Related U.S. Application Data

(60) Provisional application No. 61/310,637, filed on Mar. 4, 2010.

(51) Int. Cl.

| | |
|---|---|
| ***E04D 13/00*** | (2006.01) |
| ***E04H 1/00*** | (2006.01) |
| ***E04B 1/94*** | (2006.01) |
| ***E04B 1/92*** | (2006.01) |
| ***E03B 1/04*** | (2006.01) |
| ***E04B 1/12*** | (2006.01) |
| ***E04B 1/343*** | (2006.01) |

(52) U.S. Cl.
CPC ..... *E04B 1/941* (2013.01); *E04D 13/00* (2013.01); *E04D 13/0477* (2013.01); *E04H 1/005* (2013.01); *E04B 2001/949* (2013.01); *Y10T 137/0318* (2015.04); *Y10T 137/698* (2015.04); *Y10T 137/6969* (2015.04)

(58) Field of Classification Search
USPC ..... 52/171.3, 220.1, 220.2, 220.3, 302.1, 52/302.3, 302.4, 168, 169.7, 192, 592.1; 137/357, 360
See application file for complete search history.

(56) References Cited

U.S. PATENT DOCUMENTS

| | | | | |
|---|---|---|---|---|
| 4,114,597 | A * | 9/1978 | Erb | 126/665 |
| 4,241,554 | A * | 12/1980 | Infantino | 52/314 |
| 4,426,999 | A * | 1/1984 | Evans et al. | 126/669 |
| 5,338,369 | A * | 8/1994 | Rawlings | 136/246 |
| 5,487,247 | A * | 1/1996 | Pigg | 52/302.3 |
| 5,536,111 | A * | 7/1996 | Doernemann | 405/16 |
| 5,608,999 | A * | 3/1997 | McNamara | 52/275 |
| 5,645,045 | A * | 7/1997 | Breslin | 126/669 |
| 5,706,620 | A * | 1/1998 | De Zen | 52/220.2 |
| 5,729,944 | A * | 3/1998 | De Zen | 52/439 |
| 5,778,471 | A * | 7/1998 | Collison | 8/158 |
| 6,059,491 | A * | 5/2000 | Striefel et al. | 405/111 |
| 6,079,170 | A * | 6/2000 | Slebos | 52/220.1 |
| 6,189,269 | B1 * | 2/2001 | De Zen | 52/220.5 |
| 6,212,845 | B1 * | 4/2001 | De Zen | 52/607 |
| 6,269,598 | B1 * | 8/2001 | Wintermantel | 52/220.1 |
| 6,526,699 | B1 * | 3/2003 | Foglio, Sr. | 52/15 |
| 6,860,073 | B2 * | 3/2005 | Chien | 52/220.1 |
| 7,231,744 | B2 * | 6/2007 | Cooper et al. | 52/199 |
| 7,297,866 | B2 * | 11/2007 | Aschenbrenner | 136/246 |
| 7,464,658 | B2 * | 12/2008 | Dhellemmes et al. | 114/74 A |
| 7,467,502 | B1 * | 12/2008 | Syla | 52/588.1 |
| 7,565,775 | B2 * | 7/2009 | Cooper et al. | 52/199 |
| 7,603,823 | B2 * | 10/2009 | Cann | 52/302.1 |
| 7,631,470 | B2 * | 12/2009 | Kinoshita | 52/591.5 |
| 7,703,248 | B2 * | 4/2010 | Dincel | 52/284 |
| 7,721,491 | B2 * | 5/2010 | Appel | 52/169.7 |
| 7,774,998 | B2 * | 8/2010 | Aschenbrenner | 52/173.3 |
| 8,074,405 | B1 * | 12/2011 | Anchondo | 52/168 |
| 8,141,322 | B2 * | 3/2012 | Appel | 52/742.1 |
| 8,297,006 | B2 * | 10/2012 | Watson | 52/169.7 |
| 8,448,403 | B1 * | 5/2013 | Wallace | 52/607 |
| 8,474,195 | B1 * | 7/2013 | Anchondo | 52/168 |
| 8,516,766 | B2 * | 8/2013 | Kuznetsov | 52/588.1 |
| 8,640,387 | B2 * | 2/2014 | Harrison et al. | 52/6 |
| 8,677,706 | B2 * | 3/2014 | Krecke | 52/302.3 |
| 8,695,298 | B2 * | 4/2014 | Jilken | 52/302.3 |
| 8,973,313 | B2 * | 3/2015 | Bettiol et al. | 52/168 |
| 2004/0050007 | A1 * | 3/2004 | Curatolo | 52/592.1 |
| 2004/0154245 | A1 * | 8/2004 | Chien | 52/220.1 |
| 2005/0199278 | A1 * | 9/2005 | Aschenbrenner | 136/251 |
| 2005/0204695 | A1 * | 9/2005 | Blazevic | 52/782.1 |
| 2006/0005491 | A1 * | 1/2006 | Cooper et al. | 52/302.1 |
| 2006/0016141 | A1 * | 1/2006 | Appel | 52/302.1 |
| 2006/0096185 | A1 * | 5/2006 | Dhellemmes et al. | 52/168 |
| 2006/0117688 | A1 * | 6/2006 | Hauck | 52/302.1 |
| 2006/0150531 | A1 * | 7/2006 | Cann | 52/11 |
| 2008/0028704 | A1 * | 2/2008 | Cooper et al. | 52/302.1 |
| 2008/0086971 | A1 * | 4/2008 | Liao | 52/592.1 |
| 2008/0110493 | A1 * | 5/2008 | Aschenbrenner | 136/251 |
| 2009/0000226 | A1 * | 1/2009 | Woods et al. | 52/220.3 |
| 2009/0133754 | A1 * | 5/2009 | Appel | 137/1 |
| 2009/0282754 | A1 * | 11/2009 | Watson | 52/169.6 |
| 2009/0301014 | A1 * | 12/2009 | Becher | 52/302.1 |
| 2010/0180524 | A1 * | 7/2010 | Jilken | 52/173.3 |
| 2011/0083384 | A1 * | 4/2011 | Russell-Smith | 52/302.1 |
| 2012/0291375 | A1 * | 11/2012 | Park et al. | 52/220.3 |
| 2013/0104994 | A1 * | 5/2013 | Bettiol et al. | 137/1 |
| 2013/0333310 | A1 * | 12/2013 | Damo | 52/173.3 |
| 2014/0034152 | A1 * | 2/2014 | Drummond | 137/363 |
| 2015/0048082 | A1 * | 2/2015 | Galal | A01G 9/02 220/4.12 |
| 2015/0135613 | A1 * | 5/2015 | Kim | E01F 7/025 52/173.1 |

FOREIGN PATENT DOCUMENTS

| | | | |
|---|---|---|---|
| DE | 19800030 | | 7/1999 |
| GB | 293224 | | 7/1928 |
| GB | 2291924 | | 7/1996 |
| GB | 2344132 | | 5/2000 |
| JP | 07229172 | A | 8/1995 |
| JP | 09221837 | A | 8/1997 |
| WO | WO 2004040076 | A1 * | 5/2004 |
| WO | WO 2011106884 | A1 * | 9/2011 |

* cited by examiner 58
22
64
56

3E
B
26
60
58
D
72
56
C
70
74
76
22

146
142

28

80
78

140
8D
8D
144
142
8D
8D 22
26
140
58
140
22

148
144
20

144
8D
8D
140
8D
8D
142

BUILDING ENVELOPE MEMBER WITH INTERNAL WATER RESERVOIR

CROSS-REFERENCE TO RELATED APPLICATIONS

This application is a Continuation of U.S. patent application Ser. No. 13/581,644 filed on Aug. 29, 2012, and entitled BUILDING ENVELOPE MEMBER WITH INTERNAL WATER RESERVOIR, which claims priority and is a Submission Under 35 U.S.C. §371 for U.S. National Stage Patent Application of International Application Number PCT/CA2011/000237, filed on Mar. 4, 2011, and entitled BUILDING ENVELOPE MEMBER WITH INTERNAL WATER RESERVOIR, which is related to and claims priority to U.S. Patent Application Ser. No. 61/310,637, filed Mar. 4, 2010, the entirety of both are incorporated herein by reference.

FIELD OF INVENTION

The present invention relates to buildings, and more particularly to modular buildings.

BACKGROUND OF THE INVENTION

There are many applications in which it is necessary to provide buildings at a remote site, such as in the aftermath of a natural disaster, for military purposes or to provide aid to underdeveloped nations. Such buildings may be temporary, or may be substantially permanent. In addition to the difficulties imposed by the logistics of transporting such buildings to the site and assembling them, in many cases the site at which the building is to be deployed lacks basic infrastructure such as water supply and sewage disposal, either because the infrastructure was destroyed or did not exist in the first place.

SUMMARY OF THE INVENTION

The present invention provides an easily assembled building which includes rudimentary plumbing and can be transported as a set of disassembled modular parts and then assembled on site. The building includes a water reservoir in the roof and a sewage reservoir in the base, so as to enable gravity-based water supply and sewage disposal.

In one aspect, the present invention is directed to a building, comprising a roof having at least one internal water reservoir. The roof has at least one externally accessible reservoir fill aperture communicating with the at least one internal water reservoir for filling the at least one internal water reservoir, and has at least one reservoir supply aperture communicating with the at least one internal water reservoir for drawing water from the at least one internal water reservoir. The roof is secured to a plurality of outer walls supporting the roof, and the outer walls are secured to a base supporting the outer walls.

In one embodiment, the building further comprises at least one plumbing fixture, with each plumbing fixture having a fixture inlet in fluid communication with one of the at least one reservoir supply aperture to receive water from the internal water reservoir.

Preferably, the base has at least one internal sewage reservoir and has at least one sewage inlet aperture communicating with the at least one internal sewage reservoir to receive sewage into the at least one internal sewage reservoir and at least one sewage outlet aperture communicating with the internal sewage reservoir for removing sewage from the at least one internal sewage reservoir. In a particularly preferred embodiment, the building further comprises at least one plumbing fixture, with each plumbing fixture having a fixture inlet in fluid communication with one of the at least one reservoir supply aperture to receive water from the internal water reservoir and also having a fixture outlet in fluid communication with one of the least one sewage inlet aperture to deliver water from the plumbing fixture to the internal sewage reservoir.

In another aspect, the present invention is directed to a building envelope section for a modular building. The building envelope section comprises a plurality of hollow structural members for forming a main body of the building envelope section. Each of the structural members has two opposed faces, two opposed outer edges extending between the faces, and at least one reinforcement extending between the faces and disposed between the outer edges. Each structural member is connected to an adjacent structural member in edge-to-edge relation therewith to form the main body of the building envelope section. The outer edges and the at least one reinforcement permit fluid passage therepast, and each structural member is in fluid communication with each adjacent structural member so that the structural members cooperate to define an internal reservoir within the main body of the building envelope section. The internal reservoir permits fluid flow between adjacent structural members, and has at least one inlet aperture and at least one outlet aperture and is otherwise sealed. In a preferred embodiment, each outer edge has connectors for connecting the structural members together, and each structural member is connected to each adjacent structural member by the connectors. The building envelope section may be, for example, a roof section or a base section.

In another aspect, the present invention is directed to a kit for assembling buildings as described above.

In a further aspect, the present invention is directed to a method for operating a plumbing fixture inside a building. The method comprises drawing water from a water reservoir disposed within a roof of the building along a fluid communication path into a fixture inlet of the plumbing fixture. The method preferably further comprises draining water from a fixture outlet of the plumbing fixture into a sewage reservoir disposed within a base of the building.

BRIEF DESCRIPTION OF THE DRAWINGS

These and other features of the invention will become more apparent from the following description in which reference is made to the appended drawings, in which.

Figure 1C:
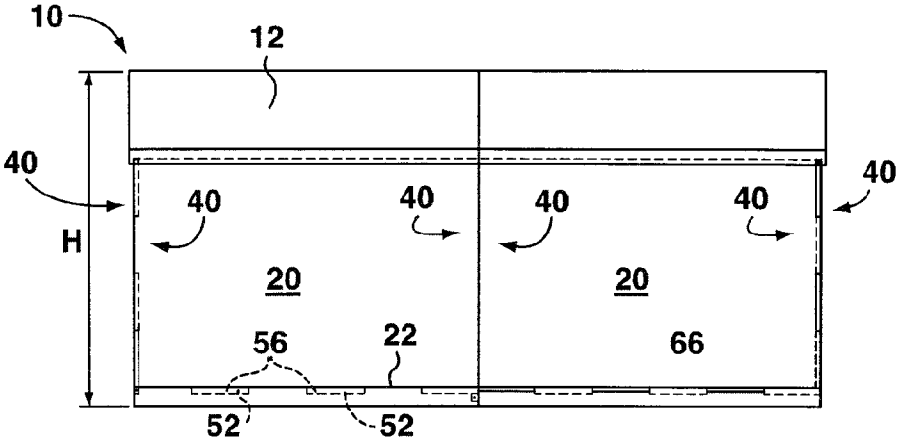
FIG. 1C is a side view of the building of FIG. 1A.

Not all reference numerals are marked in all Figures.

DETAILED DESCRIPTION

According to aspects of the present invention, buildings which include rudimentary plumbing can be transported as a set of disassembled modular parts and then assembled on site.

Figure 9B:
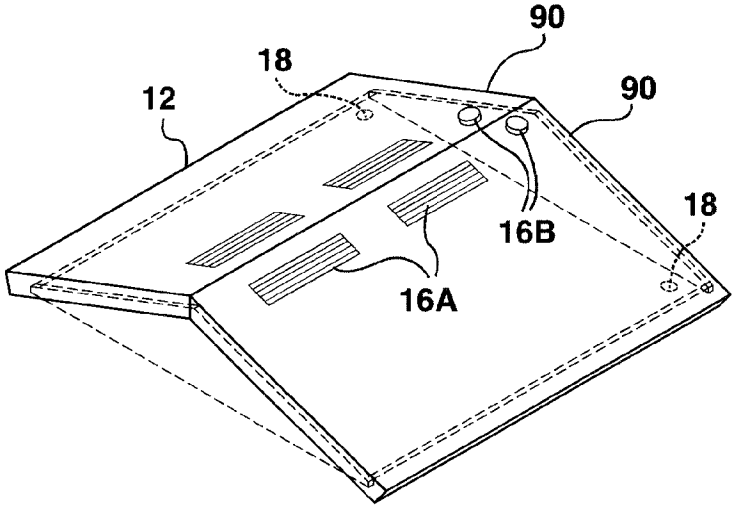
FIG. 9B is a perspective view of a second portion of the roof of the building of FIG. 1A.
Figure 9C:
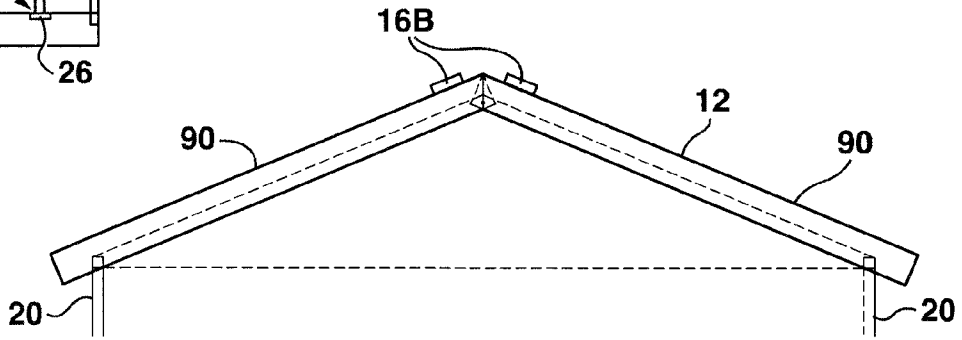
FIG. 9C is an end view of the roof of FIG. 9B.
Figure 9A:
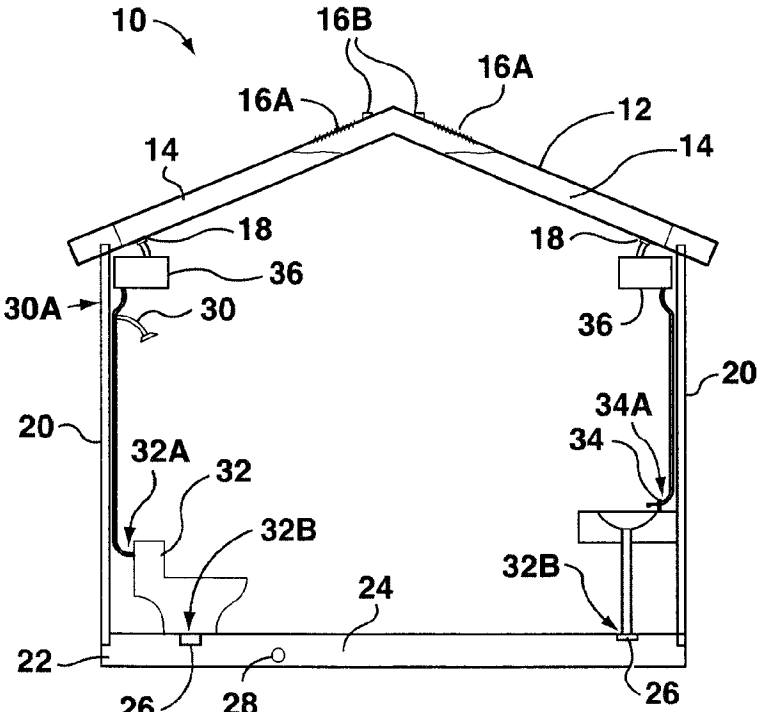
FIG. 9A is an interior end view of the building of FIG. 1A.

Referring now to FIGS. 1A to 1C, 2 and 9A to 9C, a first exemplary building according to an aspect of the present invention is shown generally at 10. The building 10 comprises a roof 12 having internal water reservoirs 14 (FIG. 9A). As best seen in FIGS. 9A and 9B, the roof 12 includes externally accessible reservoir fill apertures 16A, 16B communicating with the internal water reservoirs 14 to enable the internal water reservoirs 14 to be filled and reservoir supply apertures 18 communicating with the internal water reservoirs 14 to enable water to be drawn from the internal water reservoir 14. In the illustrated embodiments, the reservoir fill apertures comprise gratings 16A for capturing rainwater and a fitting 16B which may be connected to a supply line, such as from a water supply vehicle or water supply system if available. Alternatively, only a grating, or only a fitting, may be used.

Referring specifically to FIG. 9A, the roof 12 is secured to a plurality of outer walls formed by outer wall sections 20 that support the roof 12, and the outer wall sections 20 are secured to a base 22 that supports the outer wall sections 20. The base 22 has an internal sewage reservoir 24, and has at least one sewage inlet aperture 26 communicating with the internal sewage reservoir 24 for receiving sewage into the internal sewage reservoir 24 and a sewage outlet aperture 28 communicating with the internal sewage reservoir 24 for removing sewage from the internal sewage reservoir 24. The building 10 also includes a plurality of plumbing fixtures, in this case a shower 30, a toilet 32 and a faucet 34. As best seen in FIG. 9A, each of the plumbing fixtures 30, 32, 34 has a respective fixture inlet 30A, 32A, 34A in fluid communication with a corresponding reservoir supply aperture 18 and a respective fixture outlet 30B, 32B, 34B in fluid communication with a corresponding sewage inlet aperture 26. Fluid communication may be achieved, for example, by way of pipes or suitable flexible tubing. As shown in FIG. 9A, water handling apparatus 36, including filtration systems, heaters, and the like, may be interposed between the reservoir supply apertures 18 and the respective fixture inlets 30A, 32A, 34A. As such, water stored in the internal water reservoirs 14 in the roof 12 can be used to supply the plumbing fixtures 30, 32, 34, for example by a gravity feed, and water that has passed through the plumbing fixtures 30, 32, 34 can be drained through the sewage inlet apertures 26 into the internal sewage reservoir 24, which can be periodically emptied by way of the sewage outlet aperture 28 or connected to a sewage processing system if available.

Figure 2:
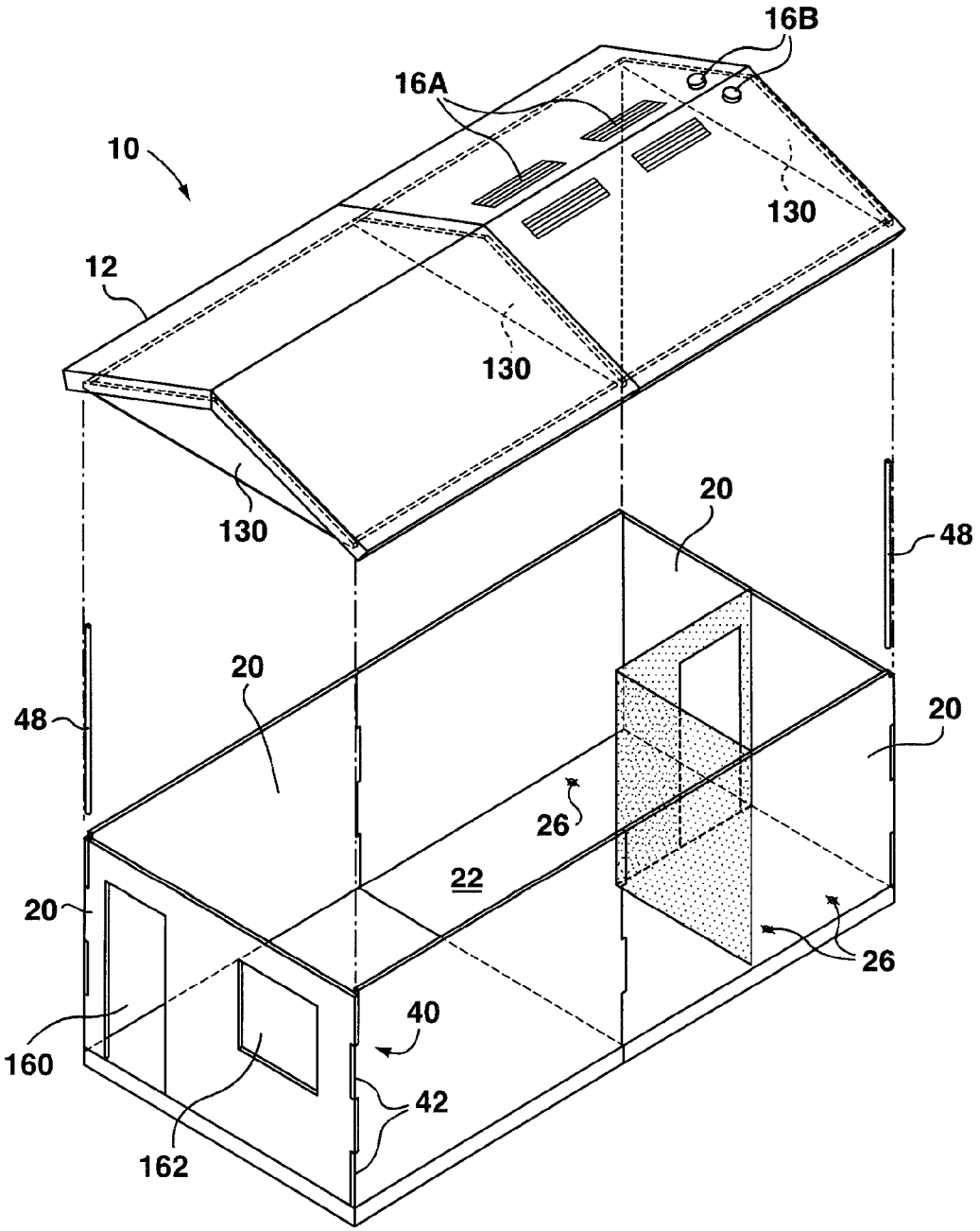
FIG. 2 is a partially exploded view of the building of FIG. 1A.

Referring now to FIGS. 2 and 4A to 4D, the outer wall sections 20 have creniform side edges 40 defining a series of alternating wall connecting projections 42 and wall connecting recesses 44. The wall connecting projections 42 and the wall connecting recesses 44 are of corresponding size, shape and position. Each outer wall section 20 is secured to two adjacent outer wall sections 20 by interlocking engagement of the creniform side edges 40. More particularly, the wall connecting projections 42 on the side edges 40 of each outer wall section 20 are received in the wall connecting recesses 44 of the side edges 40 of each adjacent outer wall section 20, for example by a friction fit or interference fit. In addition, each wall connecting projection 42 has a wall connecting bore 46 defined therethrough, with the wall connecting bores 46 through the wall connecting projections 42 on each side edge 40 being in registration with one another. Each outer wall section 20 is further secured to each adjacent outer wall section 20 by a wall connecting rod 48 extending through the wall connecting bores 46 (two such rods are shown in FIG. 2), which may be friction fit in the wall connecting bores 46.

With reference now to FIGS. 3A and 3B, 4A and 4B and 5A and 5B, the outer wall sections 20 also have creniform lower edges 50 defining a series of alternating lower edge projections 52 and lower edge recesses 54. The base 22 has spaced-apart wall mounting recesses 56 in its upper surface 58 adjacent its side edges 60 corresponding in size and position to the lower edge projections on the lower edges 50 of the outer wall sections 20. Each outer wall section 20 is secured to the base 22 by the lower edge projections 52 on the lower edges 50 of each outer wall section 20 being received in the wall mounting recesses 56 in the upper surface 58 of the base 22, for example by a friction fit or interference fit. In addition, each lower edge projection 52 has a lower edge bore 62 defined therethrough, with the lower edge bores 62 being in registration with one another, and the base 22 has a corresponding series of wall mounting bores 64 defined adjacent each side edge 60 of the base 22 and adjacent the upper surface 58 of the base 22. Each wall mounting bore 64 in the base passes through a portion of the base 22 adjacent one of the wall mounting recesses 56, in registration with one another and with the wall mounting recesses 56, and each outer wall section 20 can be further secured to the base 22 by a wall mounting rod 66 (FIG. 1C) extending through the wall mounting bores 64 and the lower edge bores 62, which may be friction fit therein.

Figures 3A, 3B, 3C, 3D, 3E:
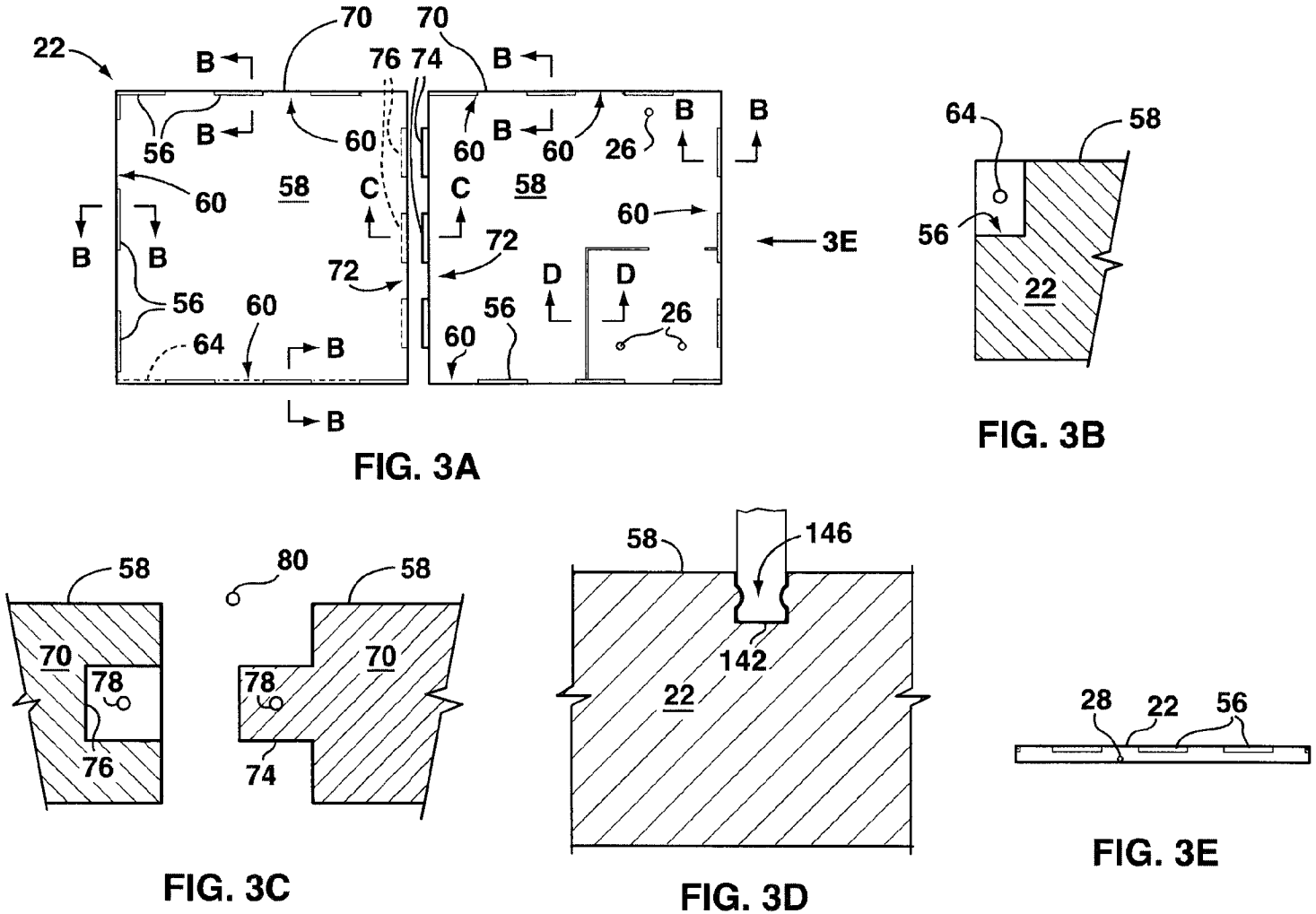
FIG. 3A is a plan view showing two adjacent base sections for the building of FIG. 1A.
FIG. 3B is a cross-sectional view of a peripheral portion one of the base sections of FIG. 3A, taken along the line 3B-3B in FIG. 3A.
FIG. 3C is a cross-sectional view of adjacent peripheral portions of the base sections of FIG. 3A, taken along the line 3C-3C in FIG. 3A.
FIG. 3D is a cross-sectional view of an intermediate portion of one of the base sections of FIG. 3A, taken along the line 3D-3D in FIG. 3A.
FIG. 3E is a side view of one of the base sections of FIG. 3A.

Now referring to FIGS. 3A and 3C, in the illustrated embodiment the base 22 comprises a plurality of base sections 70, each having at least one base connecting edge 72. Each base connecting edge 72 has one of (a) an alternating series of base connecting projections 74, or (b) an alternating series of base connecting recesses 76. The base connecting projections 74 and the base connecting recesses 76 correspond in size, shape and position. In this embodiment, the base 22 is formed by each base section 70 being secured to at least one adjacent base section 70 by way of the base connecting projections 74 being received in the base connecting recesses 76, for example by a friction fit or interference fit. In the particular embodiment shown, the base 22 comprises two base sections 70. Now referring specifically to FIG. 3C, each base connecting projection 74 has a base connecting bore 78 defined therethrough. The base connecting bores 78 through the base connecting projections 72 are in registration with one another, and additional base connecting bores 78 are defined through each portion of the base section 70 adjacent one of the base connecting recesses 76. The additional base mounting bores 78 are in registration with one another and also in registration with the base connecting recesses 76. Each base section 70 is further secured to at least one adjacent base section 70 by a base connecting rod 80 extending through the base connecting bores 78, which may be friction fit in the base connecting bores 78.

Reference is now made to FIGS. 6A to 6D and 7A to 7F. In the exemplary embodiment, the roof 12 comprises a plurality of roof sections 90. While FIGS. 6A to 6D show roof sections which do not include an internal reservoir, assembly and mounting of roof sections 90 which include the internal reservoirs 14 will be identical. Each roof section 90 has at least one roof connecting edge 92 which has an alternating series of roof connecting projections 94 and roof connecting recesses 96 which correspond in size, shape and position. The roof 12 is formed by each roof section 90 being secured to at least one adjacent roof section 90 by way of the roof connecting projections 94 being received in the roof connecting recesses 96, for example by a friction fit or interference fit. In addition, each roof connecting projection 94 has a roof connecting bore 98 defined therethrough, and the roof connecting bores 98 through the roof connecting projections 94 on each roof connecting edge 92 are in registration with one another. Each roof section 90 is further secured to at least one adjacent roof section 90 by a roof connecting rod 100 extending through the roof connecting bores 98, which may be friction fit in the roof connecting bores 98. In the illustrated embodiment, the roof 12 is an A-frame roof, and each roof section 90 has a single roof connecting edge 92 so that the roof connecting edges 92 of adjacent roof sections 90 define an apex of the roof 12.

Figure 4A:
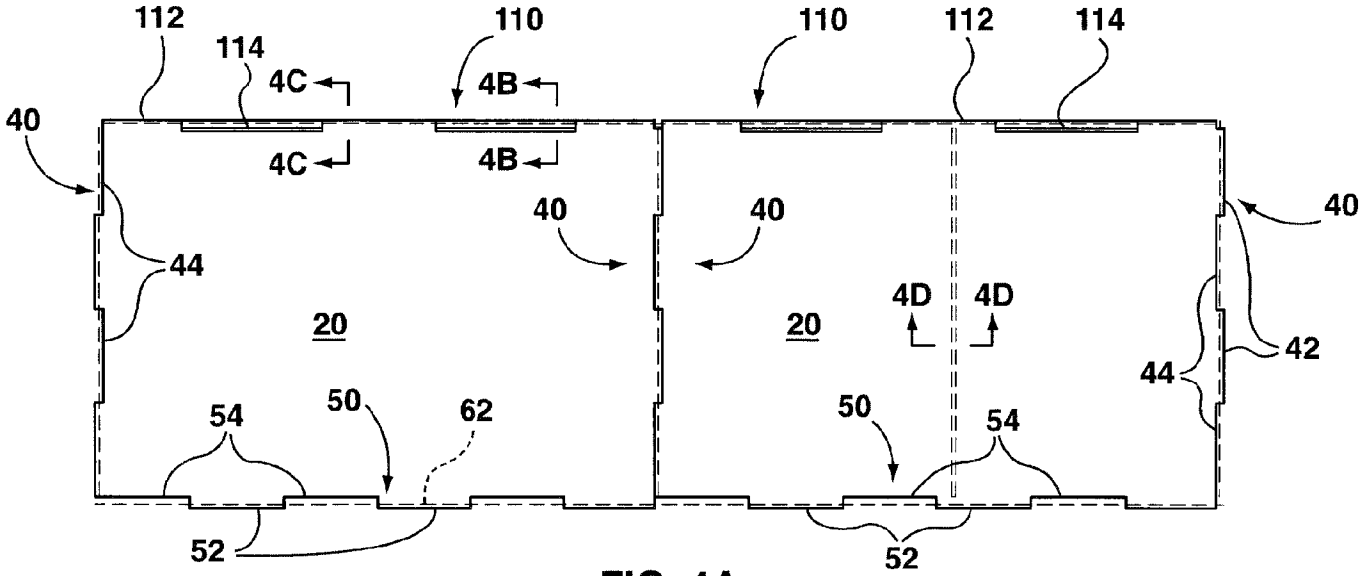
FIG. 4A is a side view showing two interlocked wall sections for side walls of the building of FIG. 1A.
Figure 4D:
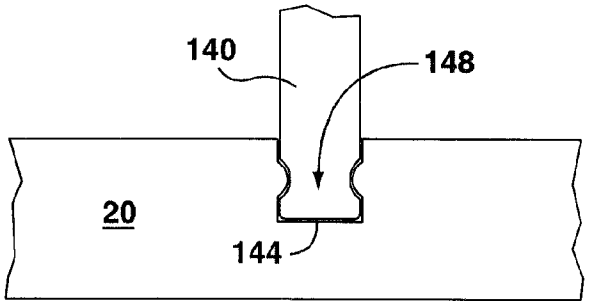
FIG. 4D is a cross-sectional view of an intermediate portion of one of the wall sections of FIG. 4A, taken along the line 4D-4D in FIG. 4A.
Figure 4C:
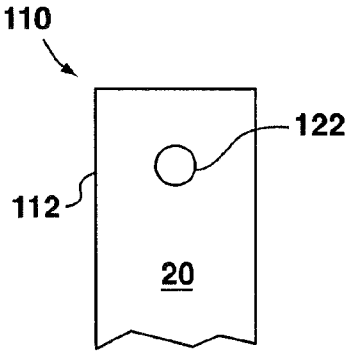
FIG. 4C is a cross-sectional view of a second upper peripheral portion of one of the wall sections of FIG. 4A, taken along the line 4C-4C in FIG. 4A.
Figure 4B:
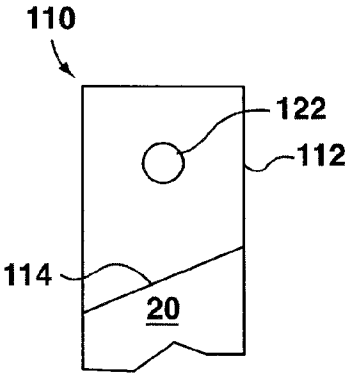
FIG. 4B is a cross-sectional view of a first upper peripheral portion of one of the wall sections of FIG. 4A, taken along the line 4B-4B in FIG. 4A.
Figure 7A:
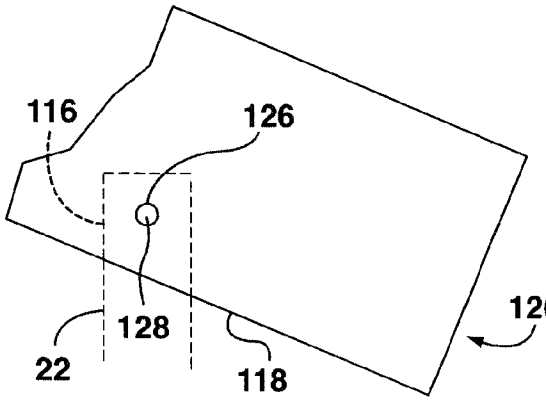
FIGS. 7A and 7B show connection of the roof of FIG. 6A to the wall sections of FIG. 4A.
Figure 7B:
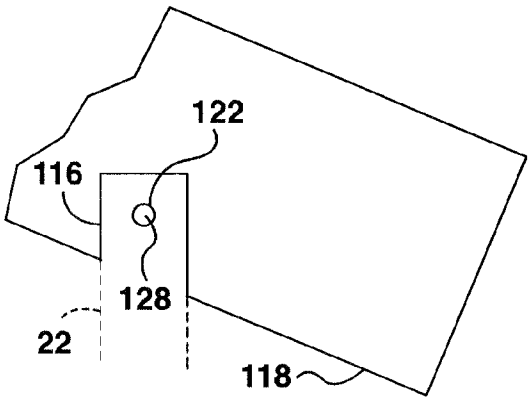
Figure 7C:
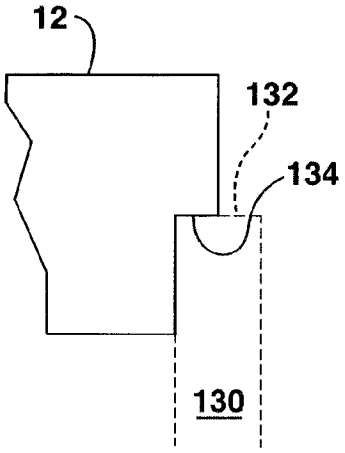
FIGS. 7C and 7F show connection of the roof of FIG. 6A to the gable panel of FIG. 5A.
Figure 7D:
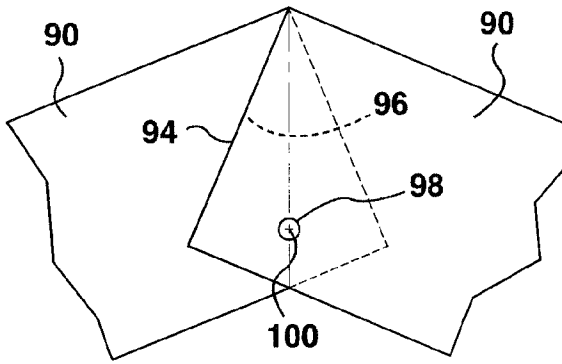
FIGS. 7D and 7E show interconnection of roof sections to form the roof of FIG. 6A.
Figure 7E:
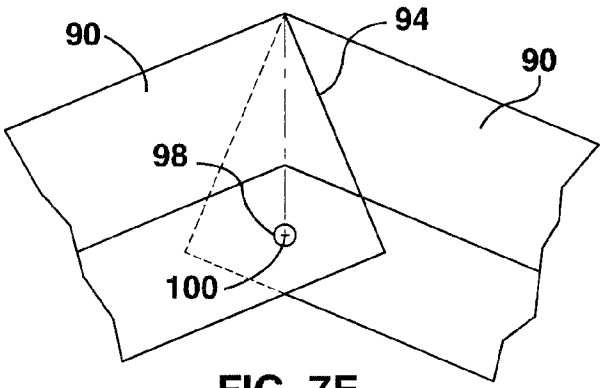
Figure 7F:
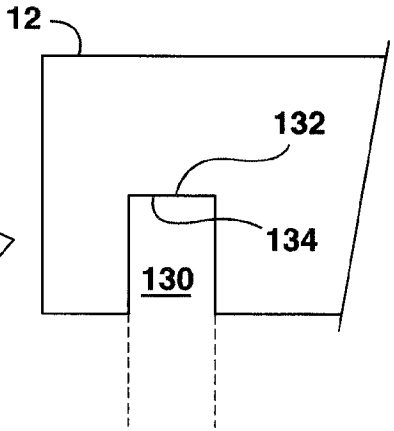
Figures 8A, 8B, 8C, 8D:
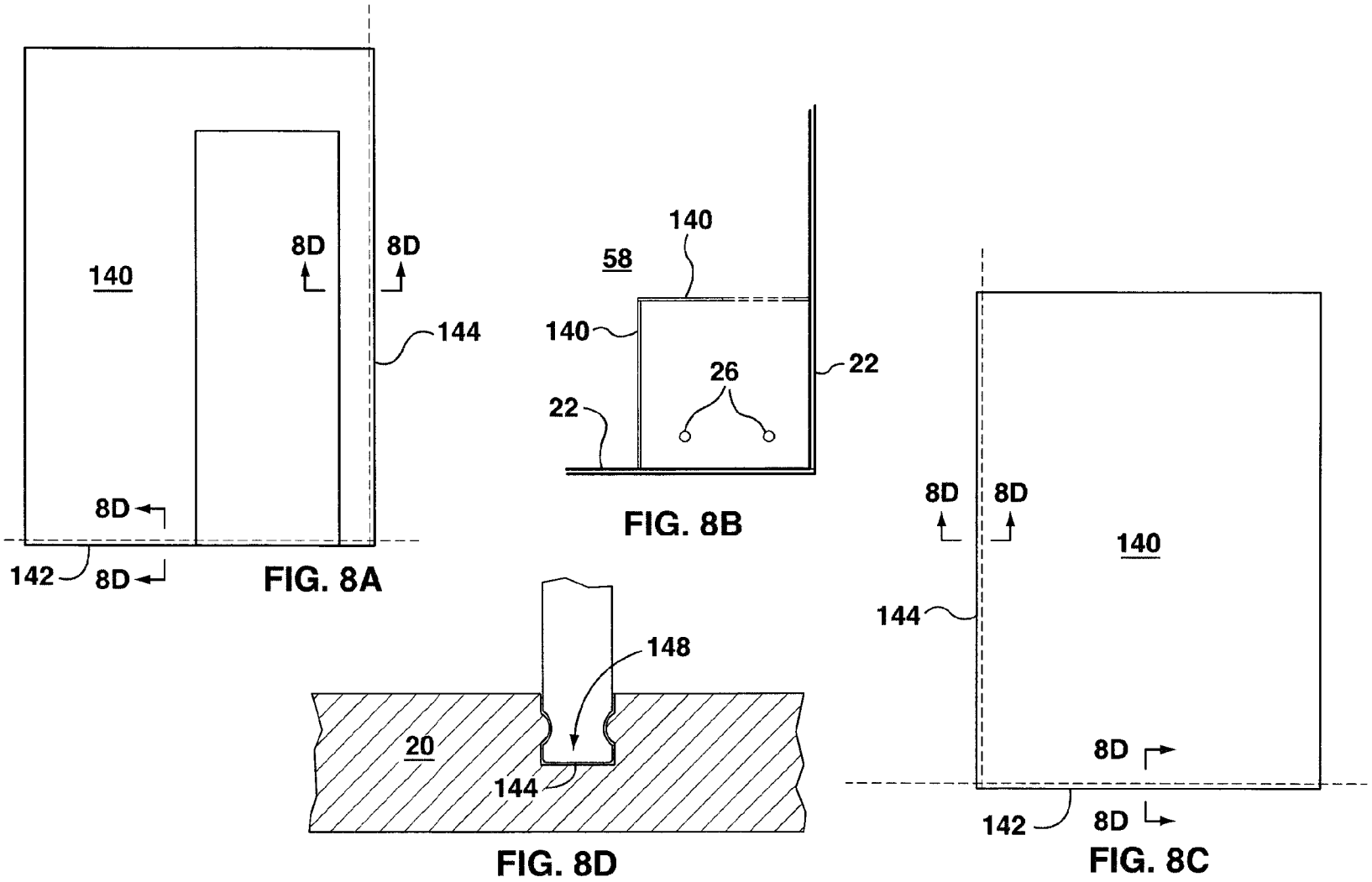
FIG. 8A shows a first interior wall for the building of FIG. 1A.
FIG. 8B is a top plan view of the first interior wall of FIG. 8A and a second interior wall and also showing an outer wall.
FIG. 8C shows the second interior wall of FIG. 8B.
FIG. 8D is a cross-sectional view taken along the line 8D-8D in FIGS. 8A and 8C.

As shown in FIGS. 4A to 4C, those outer wall sections 20 which define side walls of the building 10 have creniform upper edges 110 defining a series of alternating upper edge projections 112 and upper edge recesses 114. As shown in FIGS. 7A to 7C, the roof 12 has a series of spaced-apart roof mounting recesses 116 defined in its lower surface 118 adjacent each side edge 120 of the roof 12. The spaced-apart roof mounting recesses 116 correspond in size, shape and position to the upper edge projections 112 on the upper edges 110 of those outer wall sections 20 which define the side walls, and the roof is secured to the outer wall sections 20 by way of the upper edge projections 112 being received in the roof mounting recesses 120. Additionally, each upper edge projection 112 has an upper edge bore 122 defined therethrough. The upper edge bores 122 through the upper edge projections 112 are in registration with one another. The roof 12 has a corresponding series of roof mounting bores 126 defined adjacent each side edge 120 of the roof, with each roof mounting bore 126 passing through a portion of the roof 12 adjacent one of the roof mounting recesses 116. The roof mounting bores 126 for each side edge 120 of the roof 12 are in registration with one another and are in registration with the roof mounting recesses 116. The roof 112 is further secured to the outer wall sections 20 by a roof mounting rod 128 extending through the roof mounting bores 126 and the upper edge bores 122 in the upper edge projections 112, which roof mounting rod 128 may be friction fit therein.

Figure 5A:
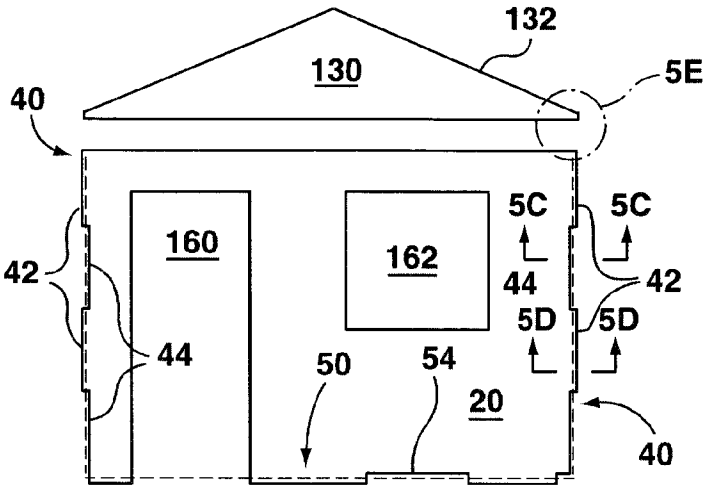
FIG. 5A is a front view of a wall section for a first end wall and a gable panel for the building of FIG. 1A.
Figure 5B:
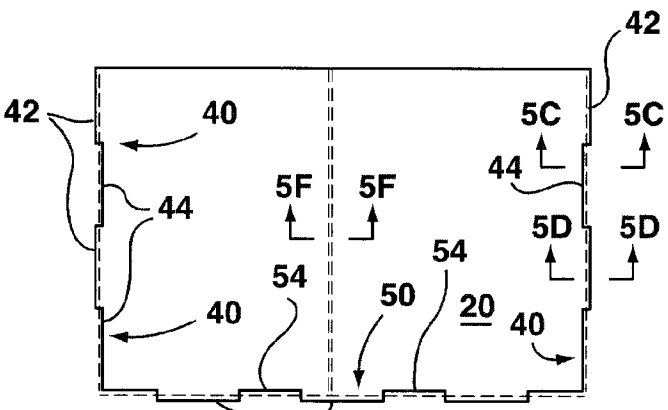
FIG. 5B is a front view of a wall section for a second end wall of the building of FIG. 1A.
Figure 5E:
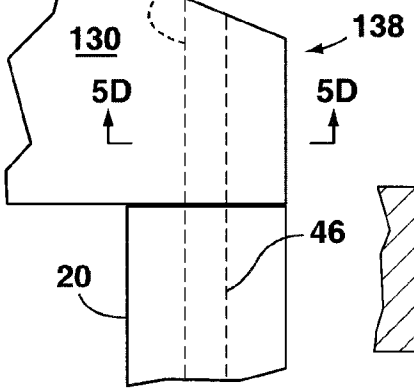
FIG. 5E is a detailed view of a peripheral portion of the gable panel of FIG. 5A and an upper portion of the wall section of FIG. 5A, secured together.
Figure 5F:
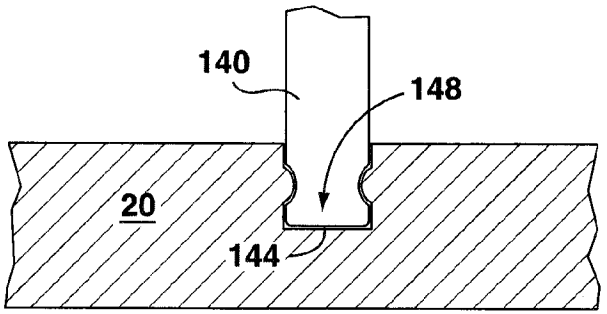
FIG. 5F is a cross-sectional view of an intermediate portion of the wall section of FIG. 5A, taken along the line 5F-5F in FIG. 5B.
Figure 5D:
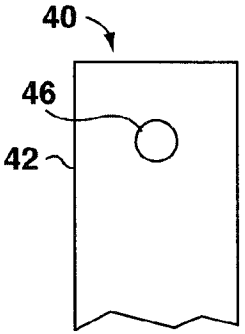
FIG. 5D is a cross-sectional view of a second peripheral portion of the wall section of FIG. 5A, taken along the line 5D-5D in FIGS. 5A and 5B.
Figure 5C:
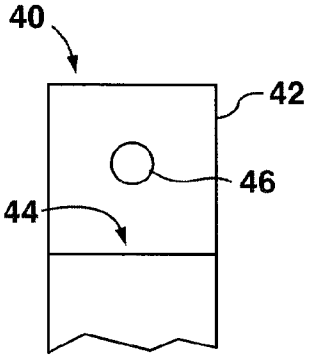
FIG. 5C is a cross-sectional view of a first peripheral portion of the wall section of FIG. 5A, taken along the line 5C-5C in FIGS. 5A and 5B.
Figure 6C:
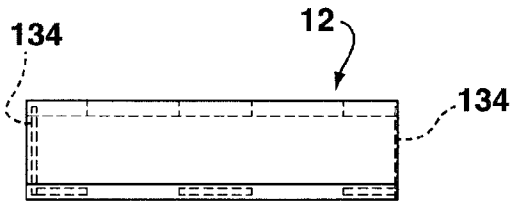
FIG. 6C is a side view of the first portion of the roof of FIG. 6A.
Figure 6D:
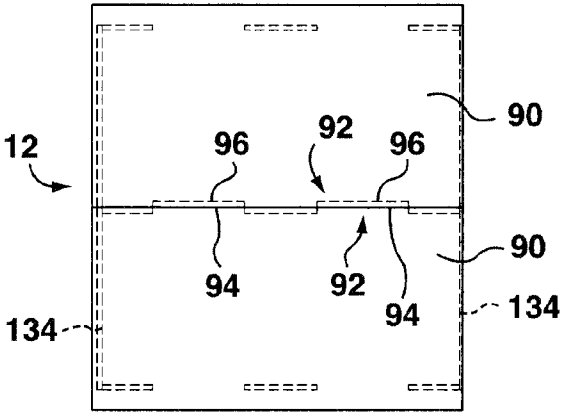
FIG. 6D is a top plan view of the first portion of the roof of FIG. 6A.
Figure 6A:
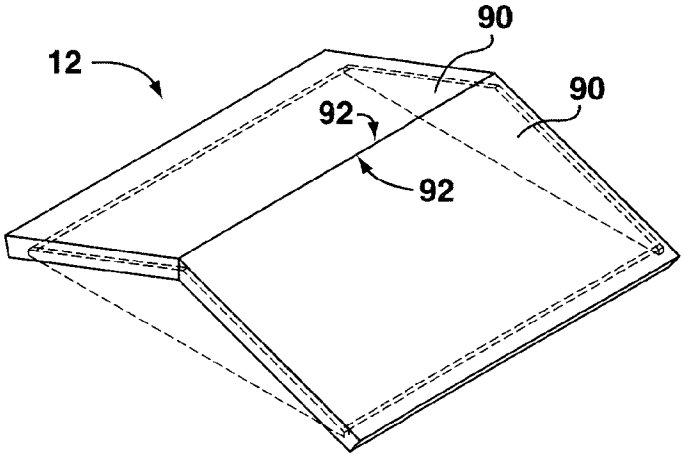
FIG. 6A is a perspective view of a first portion of the roof of the building of FIG. 1A.
Figure 6B:
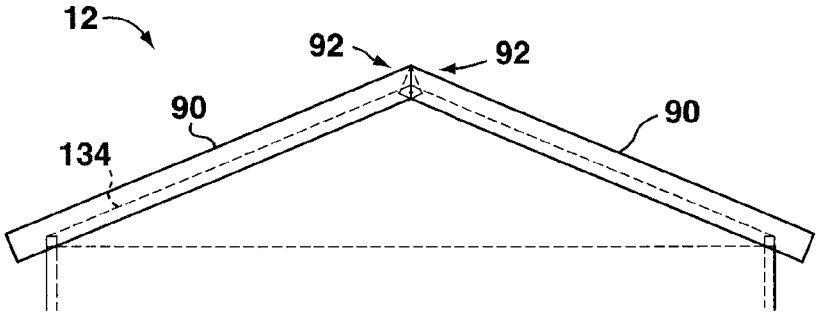
FIG. 6B is an end view of the first portion of the roof of FIG. 6A.

As best shown in FIGS. 5A, 5E, 7C and 7F, the building 10 includes a plurality of gable panels 130 supported by the outer wall sections 20 that define the end walls of the building 10, with the upper edges 132 of the gable panels 130 being received in corresponding grooves 134 on the lower surface of the roof 12. As seen in FIG. 5E, each of the gable panels 130 have downwardly extending gable mounting bores 136 defined adjacent lower side edges 138 of the gable panels. The gable mounting bores 136 are in registration with corresponding wall connecting bores 46, and the gable panels 130 are secured to the outer wall sections 20 that define the end walls of the building 10 by the wall connecting rods 48 (FIG. 2) extending through the gable mounting bores 136.

Referring now to FIGS. 2, 3A, 3D, 4D, 5F, and 8A to 8D, the building 10 may further comprise interior wall panels 140 secured to the base 22 and to the inner face of the exterior walls 20 by interference fitting between the lower edges 142 and side edges 144 of the interior walls and corresponding interior wall mounting grooves 146, 148 defined in the upper surface 58 of the base and the inner face of one or more outer wall sections 20, respectively. As shown, the interior walls 140 include a doorway aperture 150, and are used to partition a room containing the plumbing fixtures 30, 32, 34. Grooves can also be provided at the edges of interior wall panels 140 to permit interior wall panels 140 to be secured to one another.

Figure 1D:
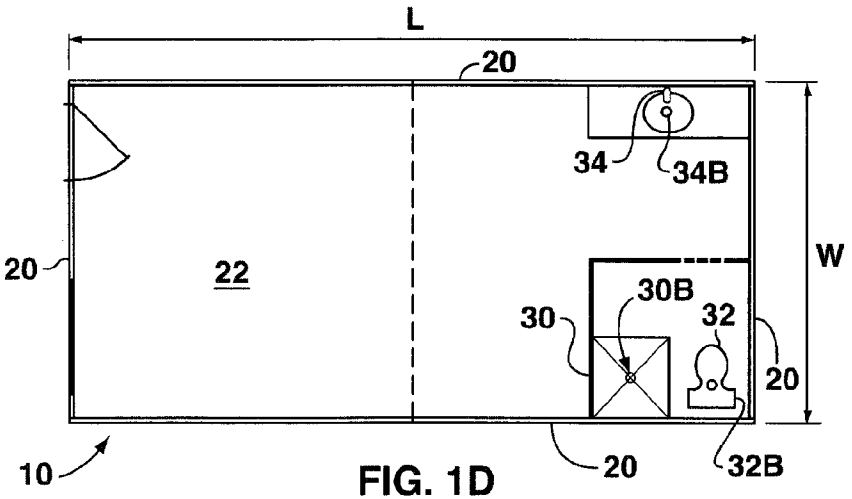
FIG. 1D is a plan view of an interior of the building of FIG. 1A, showing plumbing fixtures installed.
Figure 1A:
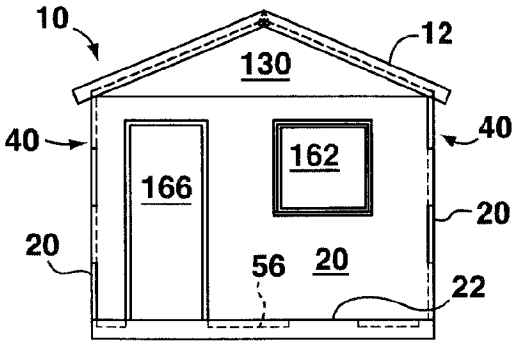
FIG. 1A is a first end view of a first exemplary building according to an aspect of the present invention.
Figure 1B:
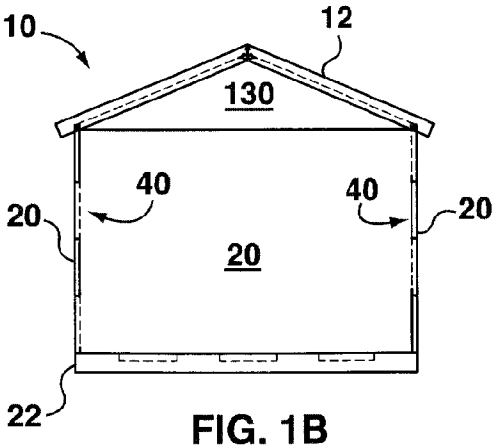
FIG. 1B is a second end view of the building of FIG. 1A.

Apertures 160, 162 for one or more doors or windows may be defined in one or more of the outside walls 20, as shown in FIGS. 1A, 2 and 5A, and a door and glass or plastic window (not shown) may be secured to such outer wall section 20 in a conventional manner.

In the illustrated embodiment, as shown in FIGS. 1C and 1D, the building 10 has a length L of approximately twenty-four (24) feet, an width W of approximately twelve (12) feet and a height H of approximately twelve (12) feet.

The various components, including the roof 12 (or roof sections 90), the base 22 (or base sections 70), the outer wall sections 20 and the gable panels 130 are made of a material which provides sufficient strength and rigidity combined with sufficiently light weight to facilitate transport. Preferably, at least the roof 12 (or roof sections 90), the base 22 (or base sections 70) and the outer wall sections 20 are hollow and are made from a suitable plastic material. More preferably, the roof 12 (or roof sections 90), the base 22 (or base sections 70) and the outer wall sections 20 each define a watertight interior volume, other than desired fluid entry and exit points (e.g. the projections may be solid rather than hollow so that the bores therethrough do not penetrate into the interior volume, and the recesses do not penetrate the outer surface of the relevant component). This allows the interior volume of the roof 12 (or one or more roof sections 90) to serve as an internal water reservoir 14, and allows the interior volume of the base 22 (or one or more base sections 70) to serve as an internal sewage reservoir 24. Alternatively, tanks may be housed inside the roof 12 (or one or more roof sections 90) and the base 22 (or one or more base sections 70). Additionally, some or all of the outer wall sections 20, and any base sections 70 not having an internal sewage reservoir 24, may be filled with water or another material once the building 10 is assembled to provide additional weight and stability.

The outer wall sections 20, base sections 70 and roof sections 90 may be formed by molding, or by separately molding opposed faces of the respective outer wall sections 20, base sections 70 and roof sections 90 separately and then securing them together with suitable reinforcement extending between the opposed faces. These approaches, however, require costly specific molds. Outer wall sections, base sections and roof sections according to aspects of the present invention can also be formed by extruding hollow structural members and joining them together, as described below.

Figure 11:
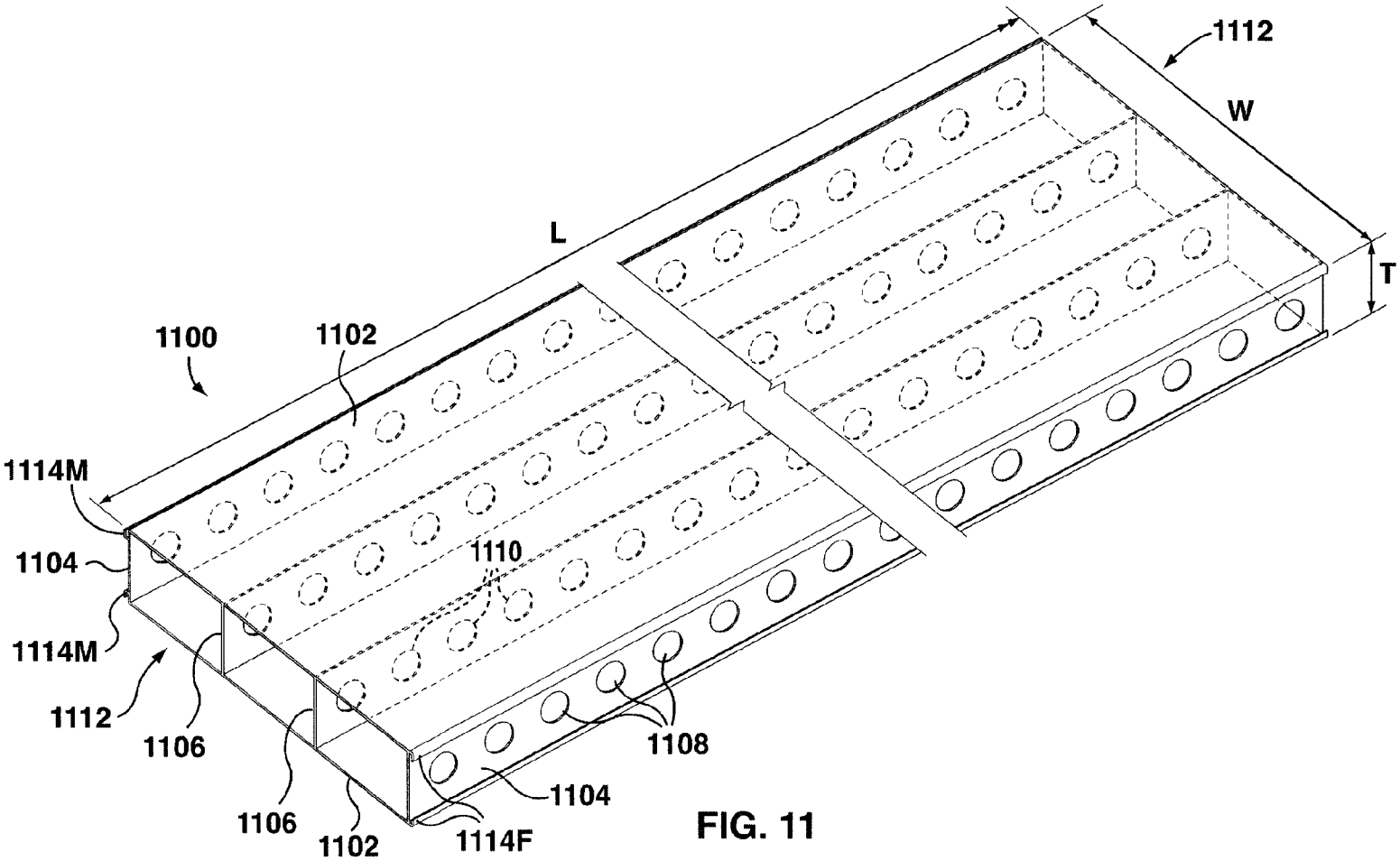
FIG. 11 shows an exemplary hollow structural member for use in constructing a building envelope section; according to an aspect of the present invention.

An exemplary hollow structural member for use in constructing a building envelope section, such as an outer wall section, a base section or a roof section is shown in FIG. 11 and is indicated generally by the reference numeral 1100. Such structural members may be formed by extrusion, and will typically have a width W of approximately three (3) feet, a thickness T of approximately seven (7) inches and can be extruded in any desired practical length L. Structural members may also be extruded in other widths and thicknesses.

The exemplary structural member 1100 has two opposed faces 1102, and two opposed outer edges 1104 extending between the faces 1102. In the illustrated embodiment the faces 1102 are planar. A plurality of reinforcements 1106 are disposed between the outer edges 1104 and extend along the length L of the structural member 1100 and extend between the faces 1102. In alternate embodiments having a shorter width W, only a single reinforcement may be required. Both the outer edges 1104 and the reinforcements 1106 permit fluid to flow past them along the width W of the structural member 1100. In the illustrated embodiment, fluid flow is enabled by a longitudinally extending series of apertures 1108, 1110 defined in the outer edges 1104 and the reinforcements 1106, respectively. The apertures 1108, 1110 may be formed following the extrusion process. In other embodiments, the outer edges and the reinforcements may comprise a series of individual members which are longitudinally spaced apart from one another so that fluid can flow between the individual members. The ends 1112 transverse to the faces 1102 and outer edges 1104 are open.

In the exemplary structural member 1100 shown in FIG. 11, the outer edges 1104 have respective male and female connectors 1114M, 1114F for connecting a plurality of structural members 1100 together, with one outer edge 1104 having a male connector 1114M and the other having a female connector 1114F. By connecting a plurality of structural members 1100, as described below, building envelope sections, such as roof sections, base sections and outer wall sections may be constructed.

Figure 12A:
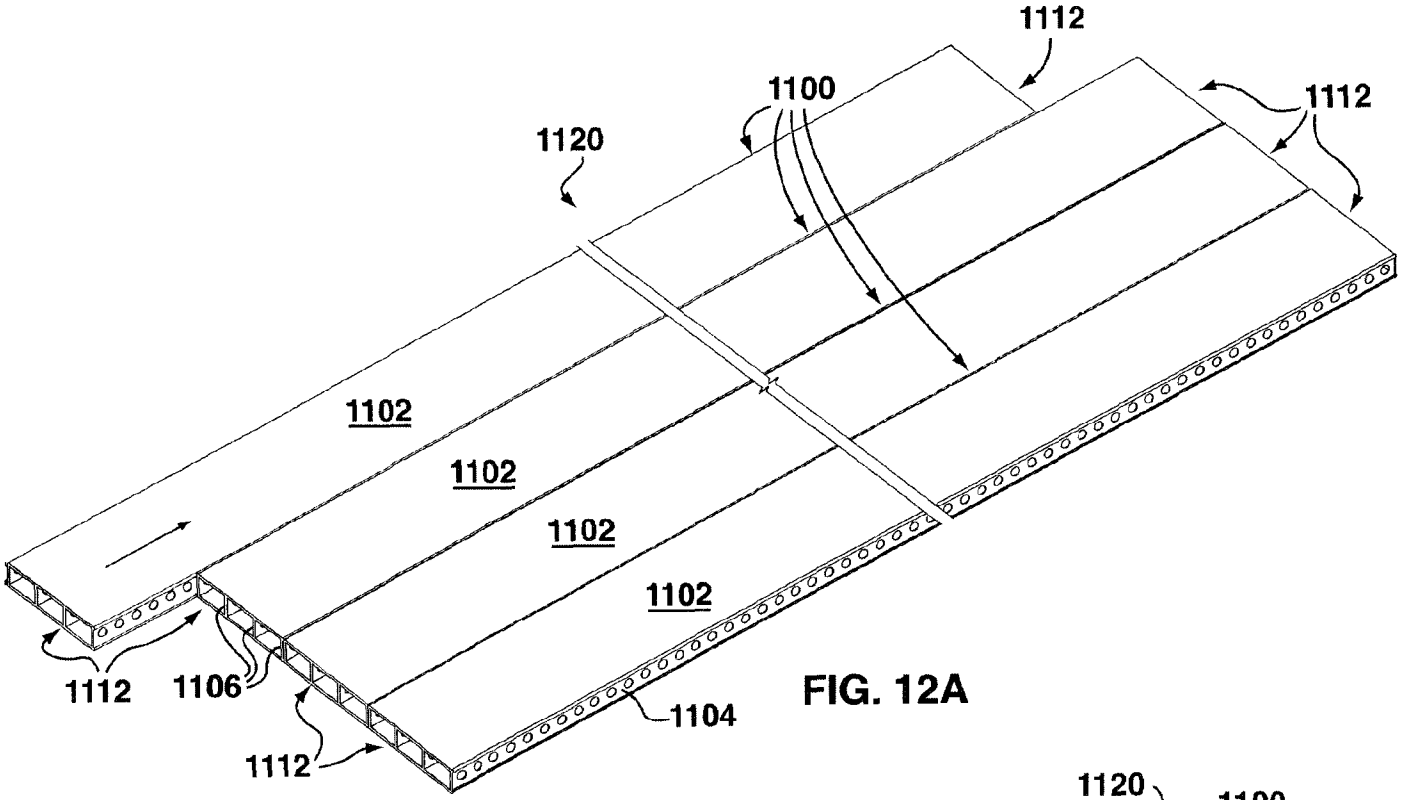
FIGS. 12A and 12B are perspective and end views, respectively, showing assembly of a main body of a building envelope section from a plurality hollow structural members as shown in FIG. 11.
Figure 12B:
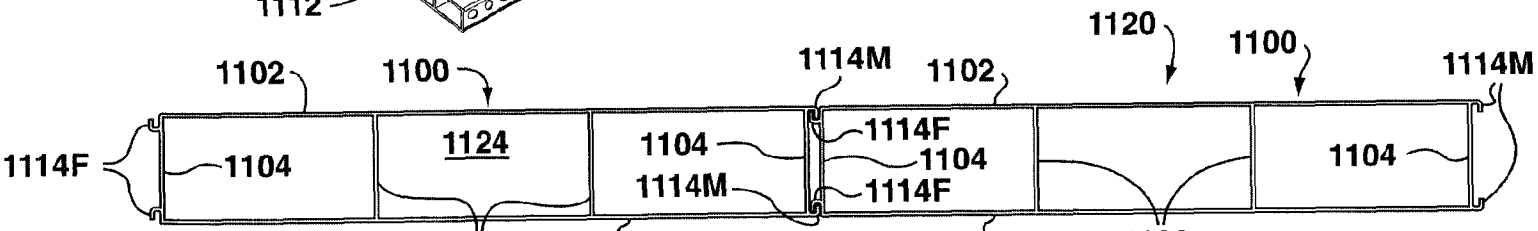

Reference is now made to FIGS. 12A and 12B, which show assembly of a plurality of structural members 1100 to form a main body 1120 of a building envelope section. In the illustrated embodiment, for each structural member 1100, one outer edge 1104 has a set of opposed male connectors 1114M extending along the length L of the structural member 1100, and the opposite outer edge 1104 has a set of correspondingly positioned female connectors 1114F also extending along the length L of the structural member 1100. The male connectors 1114M of one structural member 1100 can be securely friction fit or interference fit into the female connectors 1114F of an adjacent structural member 1100, as shown in FIG. 12B, by inserting the male connectors 1114M into the female connectors 1114F of an adjacent structural member 1100 and sliding one structural member 1100 along the other, as shown in FIG. 12A. Thus, a plurality of structural members 1100 can be assembled together, with each structural member 1100 connected in edge-to-edge relation to each adjacent structural member 1100 by the connectors 1114M, 1114F, to form the main body 1120 of a building envelope section. In such an arrangement, as shown in FIG. 12A, each structural member 1100 is in fluid communication with each adjacent structural member 1100 so that the structural members cooperate to define an internal reservoir 1124 within the main body 1120 of the building envelope section. The internal reservoir 1124 permits fluid flow between adjacent structural members 1100 by way of the apertures 1108, 1110 in the outer edges 1104 and the reinforcements 1106, respectively. The internal reservoir 1124 is completed by providing at least one inlet aperture (see FIG. 27) and at least one outlet aperture (see FIG. 27) in communication with the internal reservoir 1124, for example by drilling, and otherwise sealing the main body 1120 of the building envelope section and thereby sealing the reservoir. For example, closures (see FIG. 14) may be sealed to the open ends 1112 transverse to the faces 1102 and outer edges 1104, and to the exposed outer edges 1104 of the outermost structural members 1100, for example by welding or a sealing adhesive. Similarly, if the friction fit or interference fit of the male connectors 1114M into the female connectors 1114F does not create a seal, the seams between adjacent structural members 1100 may be sealed with a suitable sealant.

Figure 13:
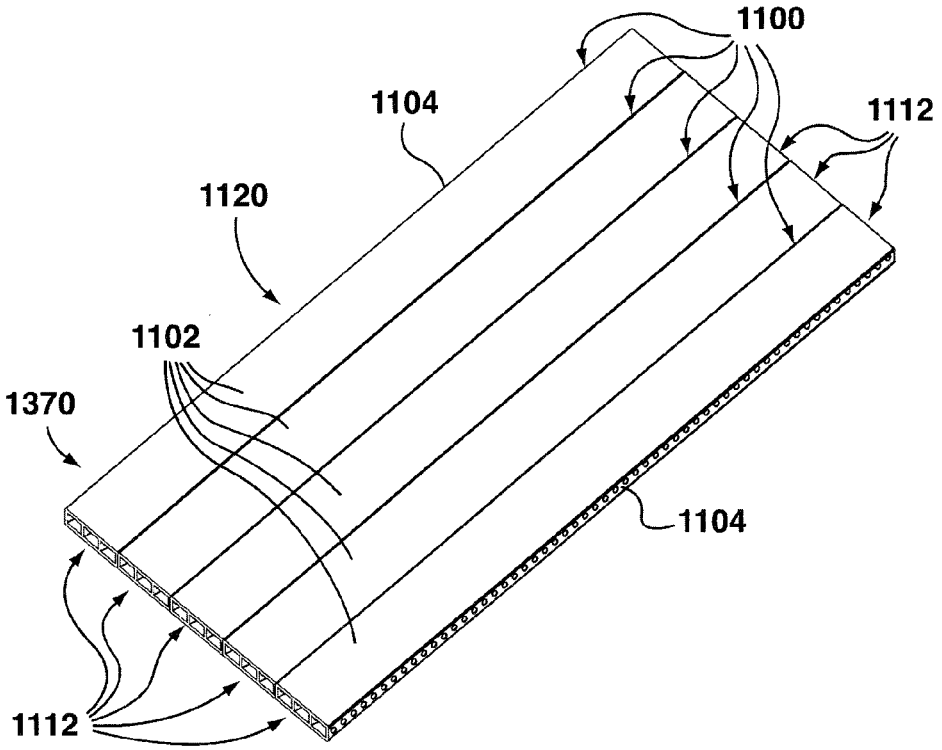
FIG. 13 is a perspective view showing a main body of a building envelope section constructed from a plurality hollow structural members as shown in FIG. 11.
Figure 14:
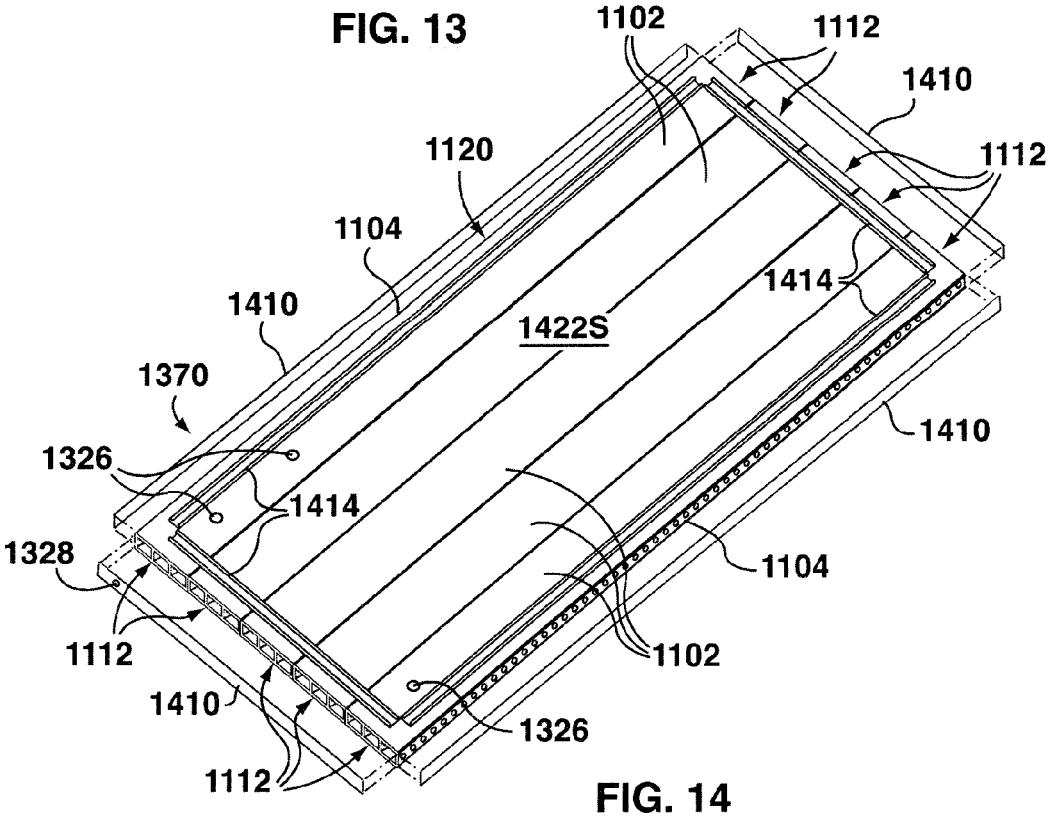
FIG. 14 is a perspective view showing construction of a base for a building from the main body of FIG. 13.

FIG. 13 shows a main body 1120 of a building envelope section, in particular a base section 1370, formed by connecting a plurality of structural members 1100 in the manner described above. As shown in FIG. 14, the internal sewage reservoir 1324 (see FIG. 27) of the base section 1370 is completed by sealing closures 1410 to the open ends 1112 of the structural members 1100 and to the exposed outer edges 1104 of the outermost structural members 1100, and forming sewage inlet apertures 1326 in the surface 1422S defined by the faces 1102 of the structural members 1100, for example by drilling and installing a suitable fitting. A sewage outlet aperture 1328 is formed in one of the closures 1410. Male connectors are secured to the surface 1422S defined by the faces 1102 of the structural members 1100. In the illustrated embodiment, the male connectors are carried by connector strips 1414 which are secured in a rectangular pattern on the surface 1422S to receive outer wall sections, as described below. The connector strips 1414 may be secured, for example, by way of a suitable adhesive or by welding.

Figure 16:
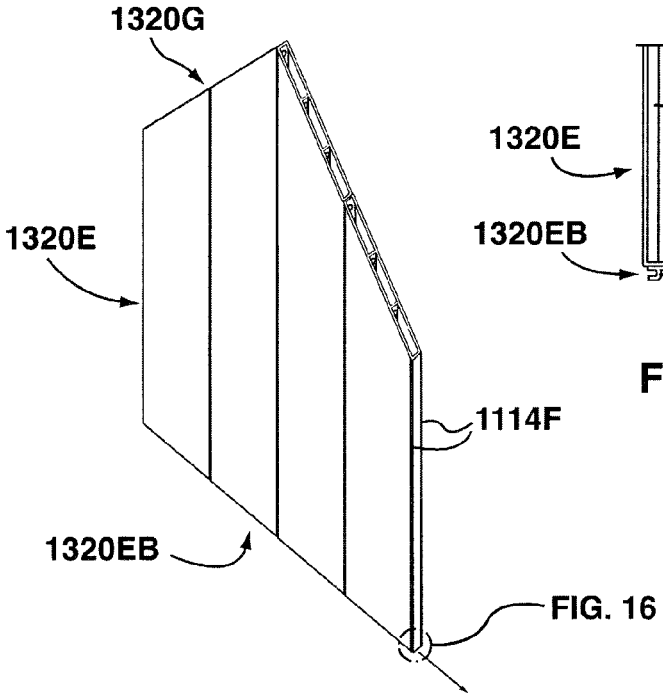
FIG. 16 is an end view of the outer end wall section of FIG. 15.
Figure 16:
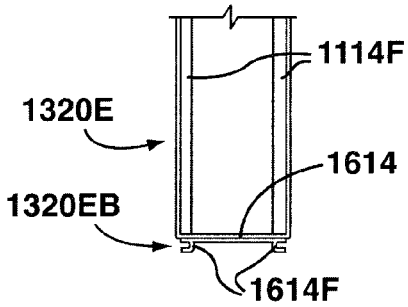
Figure 15:
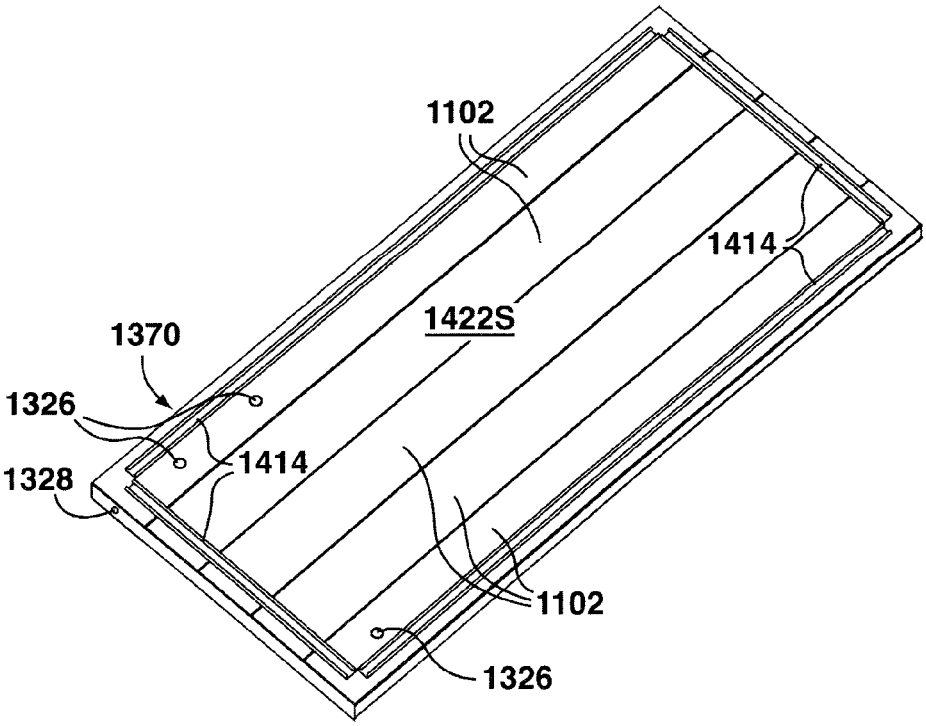
FIG. 15 is a perspective view showing mounting of an outer end wall section onto the base of FIG. 14.
Figure 18:
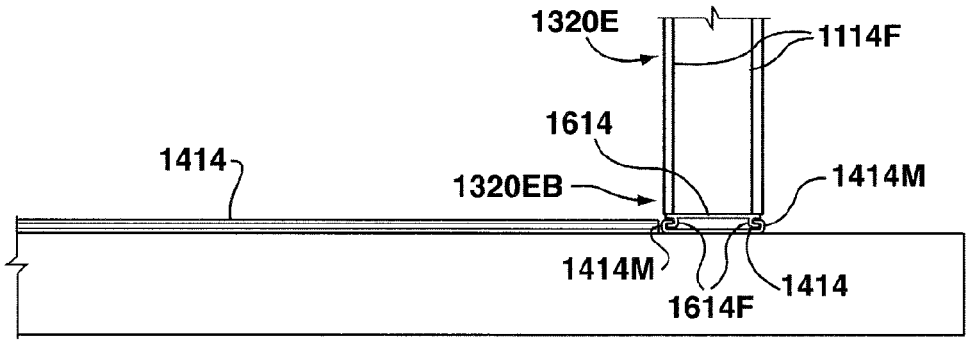
FIG. 18 is an end view showing a lower portion of the outer end wall section of FIG. 15 mounted on the base of FIG. 14.
Figure 17:
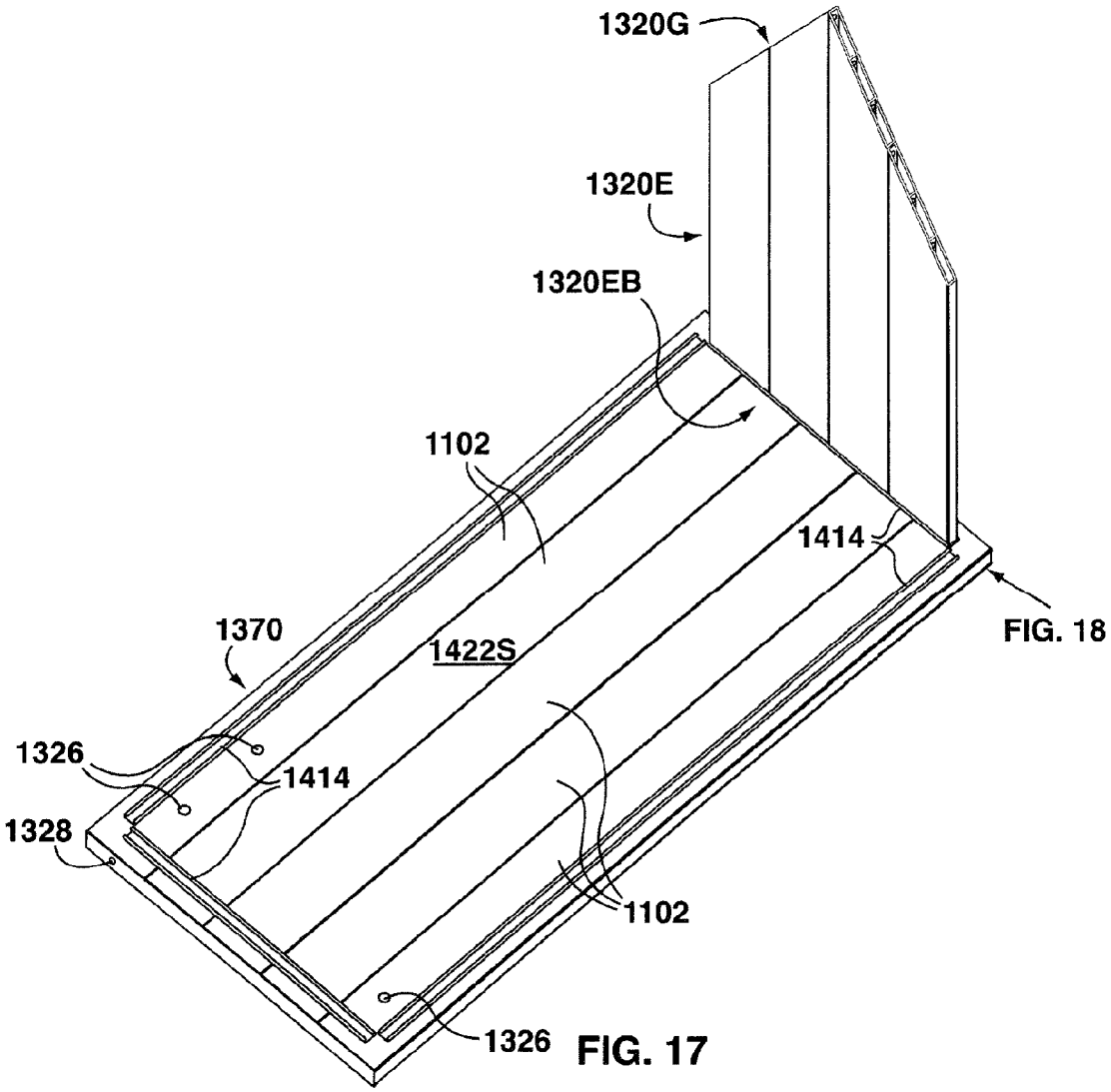
FIG. 17 is a perspective view of the outer end wall section of FIG. 15 mounted on the base of FIG. 14.
Figure 20:
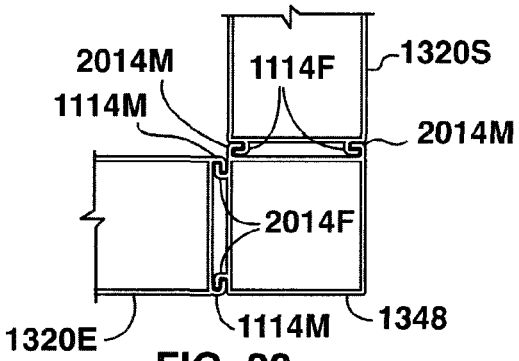
FIG. 20 is top plan view of the partially assembled building of FIG. 19, and shows a corner post connected to an outer end wall and an outer side wall.
Figure 19:
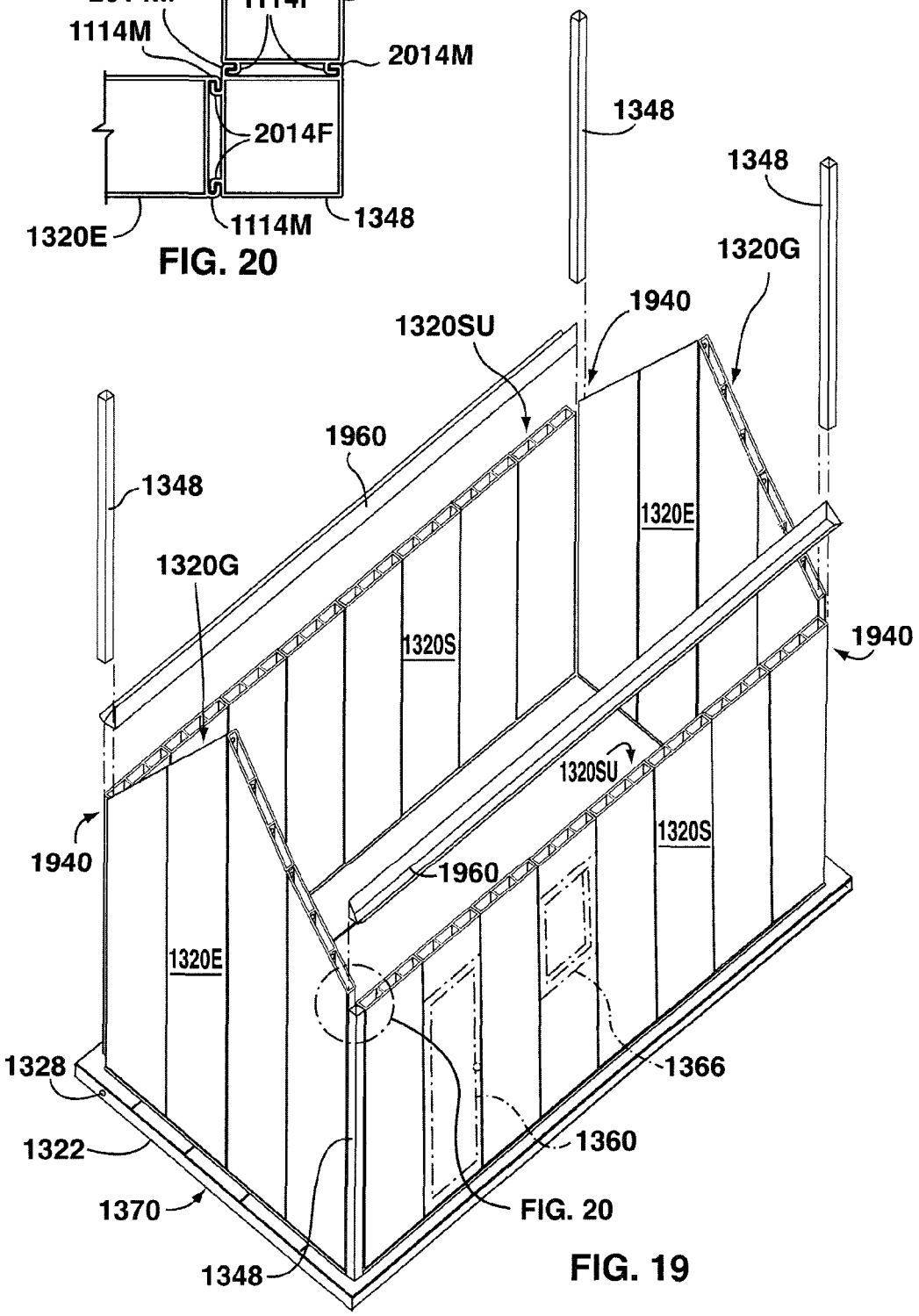
FIG. 19 is a perspective view showing a partially assembled building in which outer end wall sections and outer side wall sections are mounted on the base of FIG. 14, and shows installation of corner posts and roof cradle members.

Outer wall sections, such as outer end wall sections 1320E (FIG. 16) and outer side wall sections 1320S (FIG. 19) can be formed from a plurality of structural members, such as structural members 1100, in the manner described above in respect of FIGS. 11, 12A and 12B. As such, the outer wall sections 1320E, 1320S will include male connectors 1114M on one side edge and female connectors 1114F on the opposite side edge. Where the outer wall sections 1320E, 1320S do not include any internal reservoir, the apertures 1108, 1110 in the outer edges 1104 and the reinforcements 1106 of the structural members 1100 may be omitted. One end of each of the outer end wall sections 1320E may be cut diagonally, relative to the edges 1104, to define a chevron-shaped gable portion 1320G. The outer side walls 1320S do not include any gable portion, as can be seen in FIG. 19. As shown in FIG. 16, connector strips 1614 carrying female connectors 1614F are secured to the base ends 1320EB of the outer end wall sections 1320E and the base ends 1320SB (not shown in FIG. 16) of the outer side wall sections 1320S (FIG. 19). This enables the outer wall sections 1320E, 1320S to be secured to the base section 1370 by engaging the male connectors 1414M of the connector strips 1414 on the base section 1370 with the female connectors 1614F on the base ends 1320EB, 1320SB of the outer wall sections 1320E, 1320S and sliding the respective wall section 1320E, 1320S along the base section 1370, as shown for one outer end wall section 1320E in FIGS. 15, 17 and 18, until each outer wall section 1320E, 1320S is in the desired position, as shown in FIG. 19. In the illustrated embodiment, the outer wall sections 1320E, 1320S are arranged in a non-overlapping rectangle with square recesses 1940 at each corner.

Once the outer wall sections 1320E, 1320S have been secured in position on the base section 1370, the outer wall sections 1320E, 1320S are further secured in mutually supporting relation by way of corner posts 1348, as shown in FIG. 19. More particularly, each corner post 1348 includes one set of opposed male connectors 2014M and one set of opposed female connectors 2014F, positioned on adjacent sides of each corner post 1348, with each set of connectors 2014M, 2014F extending along the length of the corner post 1348. The male connectors 2014M and female connectors 2014F of each corner post 1348 are engaged with corresponding female connectors 1114F and male connectors 1114M on a pair of adjacent outer wall sections 1320E, 1320S and the corner post 1348 is then slid downwardly into the respective square recess 1940. A roof cradle member 1960 is then secured on the upper end 1320SU of each outer side wall 1320S and on the corner posts 1348.

Figure 21:
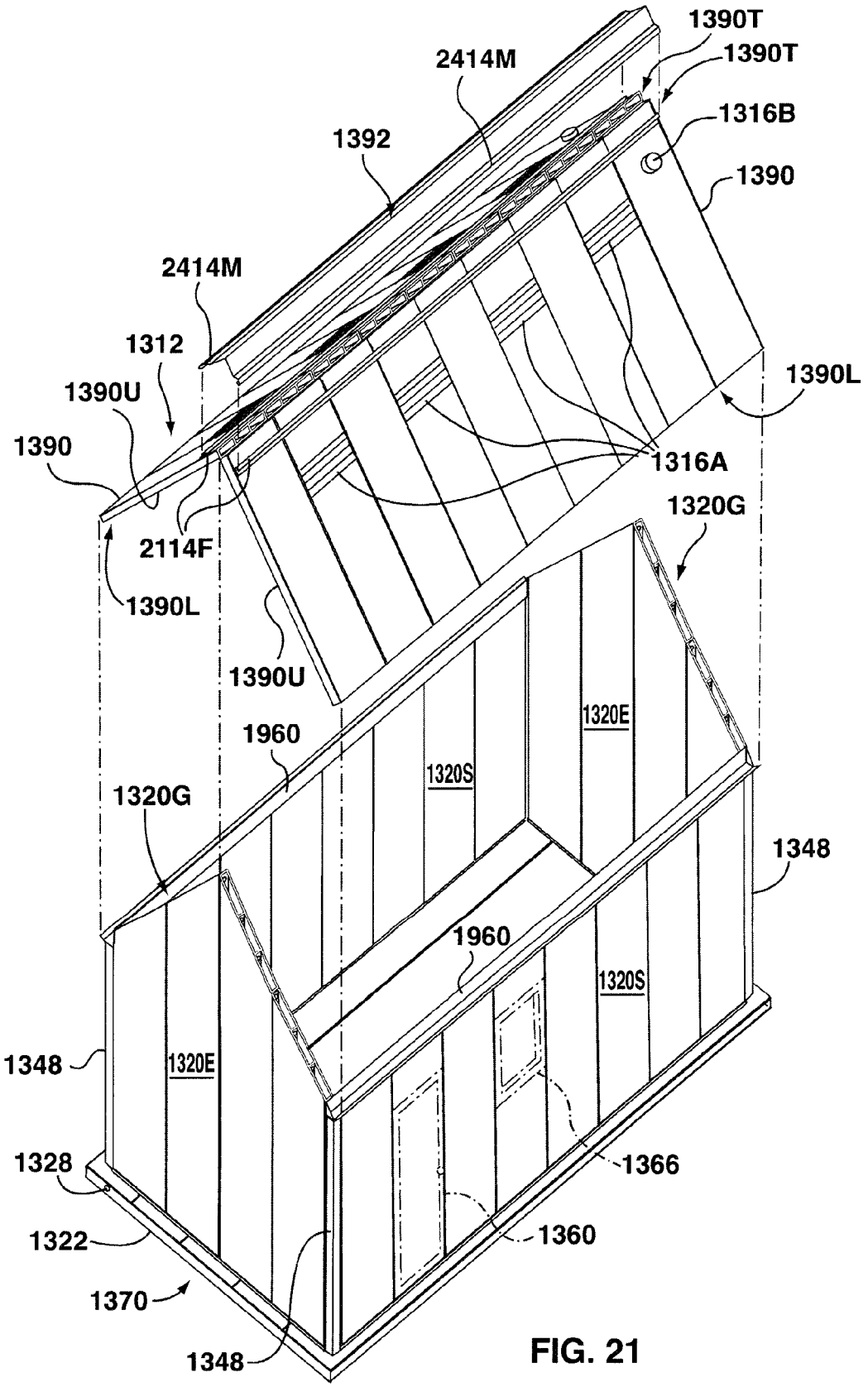
FIG. 21 is a perspective view showing the partially assembled building of FIG. 19 with corner posts and roof cradle members installed, and shows installation of roof sections and a hat member.
Figure 22:
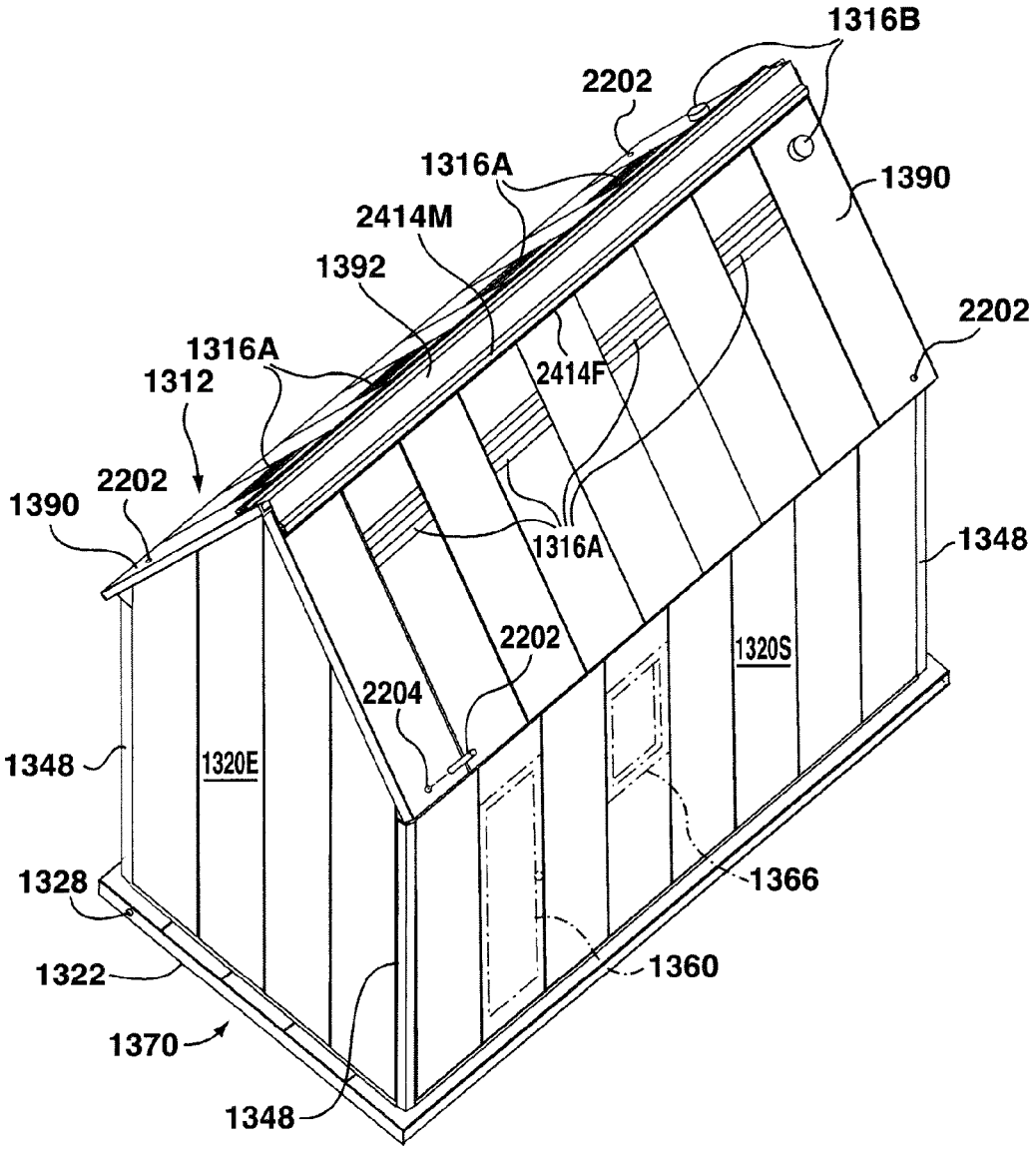
FIG. 22 is a perspective view showing a substantially completed second exemplary building according to an aspect of the present invention and showing installation of a roof post to complete the building.
Figure 25:
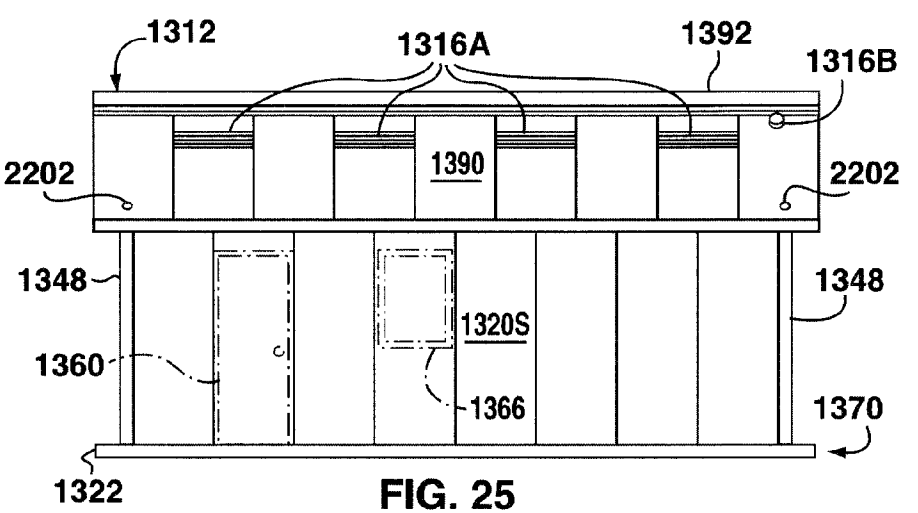
FIG. 25 is a side view of the building of FIG. 22.
Figure 26:
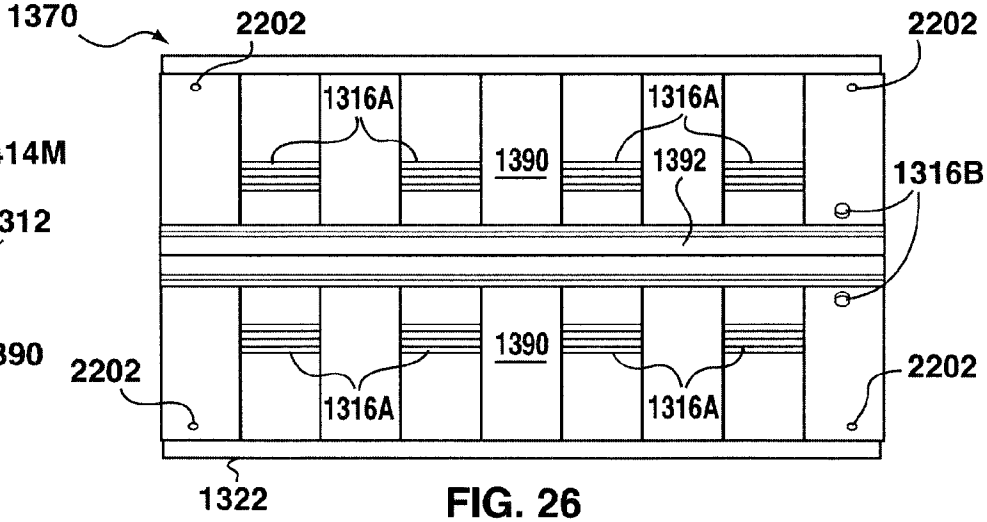
FIG. 26 is a top plan view of the building of FIG. 22.
Figure 23:
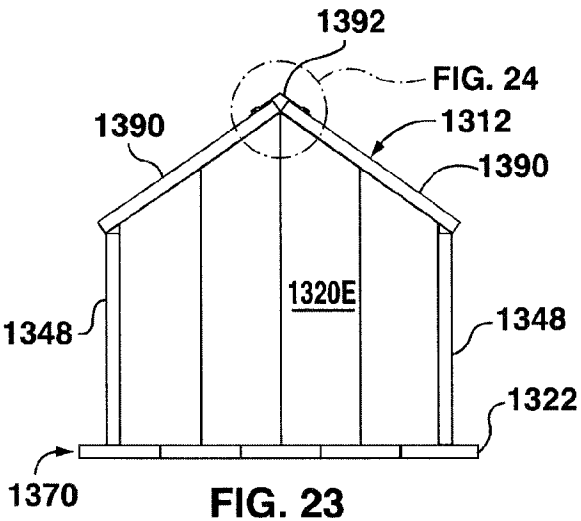
FIG. 23 is an end view of the building of FIG. 22.

Roof sections 1390 having an internal water reservoir can be constructed from a plurality of structural members 1100 in manner analogous to that described above in respect the base section 1370 and shown in FIGS. 11 to 13. FIGS. 21 and 22 shows a roof 1320 formed from two roof sections 1390 constructed in such a manner. Each roof section 1390 includes an internal water reservoir 1314 (see FIG. 27) and also includes externally accessible reservoir fill apertures 1316A, 1316B communicating with the internal water reservoir, namely gratings 1316A for capturing rainwater and a fitting 1316B which may be connected to a supply line, such as from a water supply vehicle or water supply system if available. The gratings 1316A may be installed by cutting away a portion of the upper surface of the roof section 1390. Alternatively, only a grating, or only a fitting, may be used. Each roof section 1390 also includes a reservoir supply aperture 1318 (FIG. 27) communicating with the internal water reservoir 1314 to enable water to be drawn from the internal water reservoir 1314.

Figure 24:
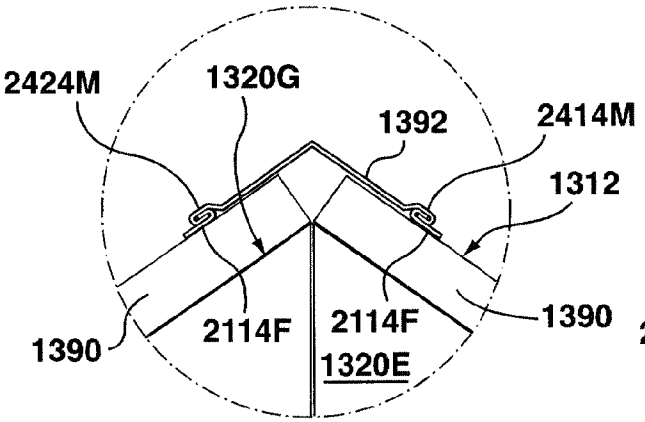
FIG. 24 is a detailed view of a portion of FIG. 23 showing securement of the hat member of FIG. 21 to the roof sections of FIG. 21.

The roof 1312 is formed by positioning each roof section 1390 so that its lower end 1390L is supported by the roof cradle member 1960 and its underside 1390U is supported by the gable portions 1320G of the outer end walls 1320E, with the upper ends of the two roof sections 1390 engaging or adjacent one another. A hat member 1392 extends along the length of the roof 1312 at the apex thereof to seal the junction between the upper ends of the two roof sections 1390. As shown in FIG. 24, the hat member 1392 is generally chevron-shaped in cross-section and includes male connectors 2414M at its outer ends and extending along its length, which are received in corresponding female connectors 2414F extending along the length of the roof sections 1390. The female connectors 2414F extending along the length of the roof sections 1390 may be secured, for example, by welding or suitable adhesive. Typically, the roof sections 1390 will be positioned first, and then the male connectors 2414M on the hat member 1392 are engaged with the corresponding female connectors 2414F on the roof sections 1390 and then the hat member 1392 is slid into position along the length of the roof 1312 and optionally sealed. The roof sections 1390 are then further secured by roof posts 2202 which pass through holes 2204 in the lower corners of the roof sections 1390 to secure the roof sections 1390 directly to the outer end walls 1320E. The roof posts 2202 and holes 2204 are sealed so that the roof posts 2202 and holes 2204 do not cause the water reservoirs 1314 in the roof sections 1390 to leak.

FIGS. 22, 23 and 25 to 27 show a completed second building 1310 according to an aspect of the present invention in which the building envelope sections, namely the base section 1370, the roof section 1390 and the outer side wall sections 13205 and outer end wall sections 1320E had their respective main bodies formed from a plurality of structural members 1100 as described above. In an exemplary embodiment, the second building 1310 may have a length of approximately twenty-four (24) feet, a height of approximately twelve (12) feet and a width of approximately twelve (12) feet. Apertures 1360, 1366 for one or more doors and or windows may be cut into one or more of the outer side wall sections 1320S and outer end wall sections 1320E. In the illustrated embodiment, the base 1322 of the building is formed by a single base section 1370, in other embodiments the base of the building may be formed by more than one base section, analogously to the first exemplary building 10 described above, but using connectors such as the connectors 1114M, 1114F. Similarly, while each of the four outer walls in the building 1320 shown in FIGS. 22, 23 and 25 to 27 are formed by a single wall section 1320S, 1320E, in other embodiments walls may be formed by joining two or more wall sections together. Additionally, aspects of the present invention are not limited to buildings of rectangular plan, and may be adapted to form buildings having more complex shapes, for example an L-shaped building.

Figure 27:
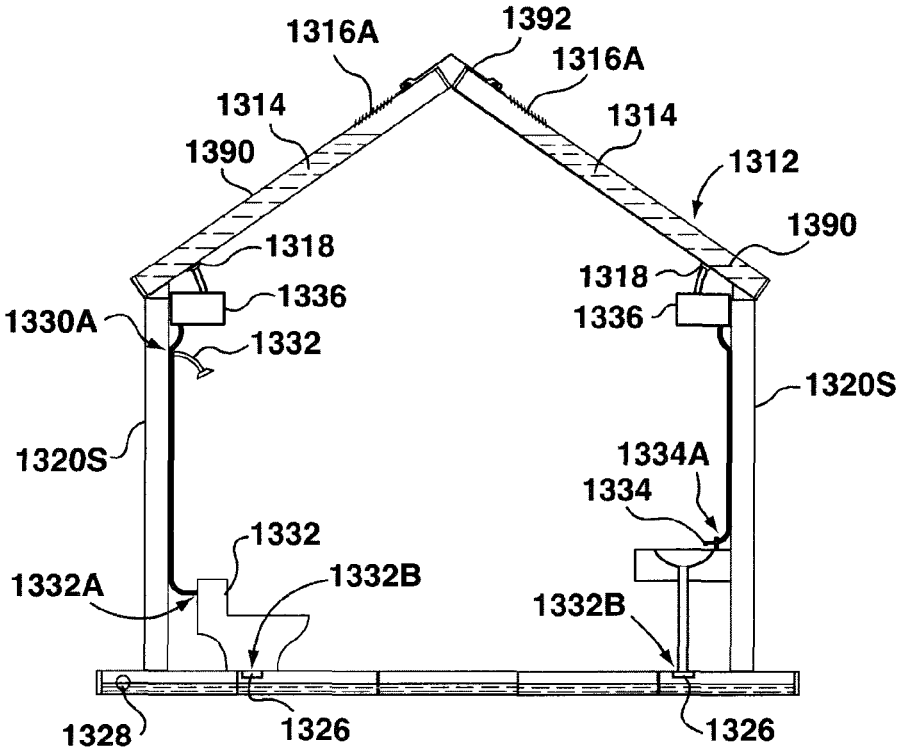
FIG. 27 is an interior end view of the building of FIG. 22.

As seen in FIG. 27, in addition to the internal water reservoirs 1314 in the roof 1312, the base 1322 has an internal sewage reservoir 1324, and has a plurality of sewage inlet apertures 1326 communicating with the internal sewage reservoir 1324 and a sewage outlet aperture 1328 communicating with the internal sewage reservoir 1324. Plumbing fixtures, namely a shower 1330, a toilet 1332 and a faucet 1334 are disposed inside the building 1310. Each plumbing fixture 1330, 1332, 1334 has a respective fixture inlet 1330A, 1332A, 1334A in fluid communication with a corresponding reservoir supply aperture 1318 and a respective fixture outlet 1330B, 1332B, 1334B in fluid communication with a corresponding sewage inlet aperture 1326. Fluid communication may be achieved, for example, by way of pipes or suitable flexible tubing. As with the first building 10, water handling apparatus 1336, including filtration systems, heaters, and the like, may be interposed between the reservoir supply apertures 1318 and the respective fixture inlets 1330A, 1332A, 1334A. As such, water stored in the internal water reservoirs 1314 in the roof 1312 can be used to supply the plumbing fixtures 1330, 1332, 1334, for example by a gravity feed, and water that has passed through the plumbing fixtures 1330, 1332, 1334 can be drained through the sewage inlet apertures 1326 into the internal sewage reservoir 1324, which can be periodically emptied by way of the sewage outlet aperture 1328 or connected to a sewage processing system if available.

Thus, as can be seen in FIG. 27, and also in FIG. 9A, aspects of the present invention enable a method for operating a plumbing fixture inside a building. According to the method, water is drawn from a water reservoir disposed within a roof of the building along a fluid communication path into a fixture inlet of the plumbing fixture. The method may further comprise draining water from a fixture outlet of the plumbing fixture into a sewage reservoir within a base of the building.

Modular buildings according to an aspect of the present invention, such as the first exemplary modular building 10 and the second modular building 1310 may be transported to a desired site in disassembled form to conserve cargo space, and then assembled on site. Once assembled, rudimentary plumbing can be provided without the need for a central water supply or sewage disposal system. Buildings of various sizes and shapes can be assembled from components according to an aspect of the present invention.

Figure 10:
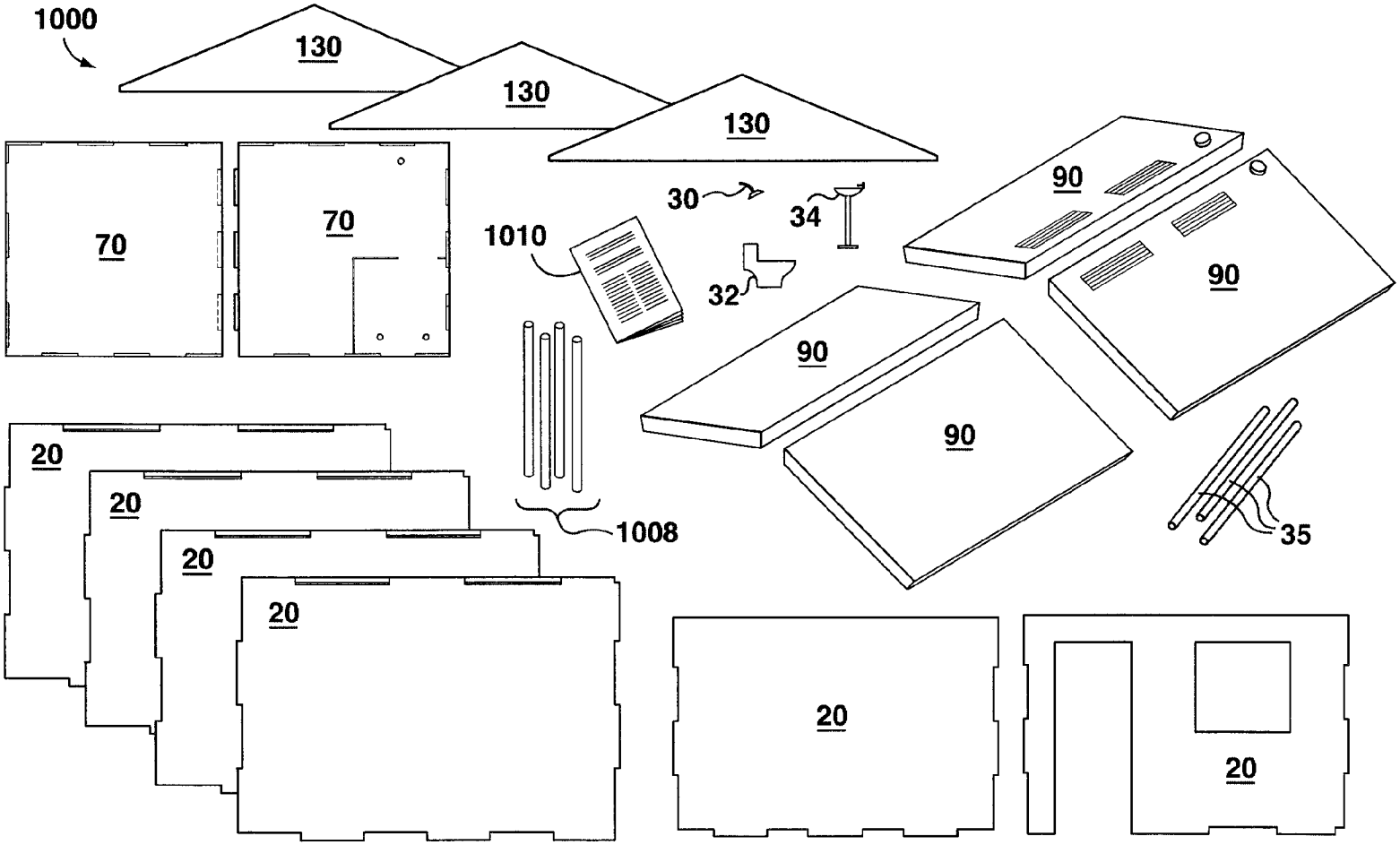
FIG. 10 shows a kit for assembling the building of FIG. 1A.

FIG. 10 shows an exemplary kit 1000 for constructing the first exemplary modular building 10. The kit 1000 comprises six outer wall sections 20, including four outer wall sections 20 for forming side walls and two outer wall sections 20 for forming end walls, four roof sections 90, including two roof sections 90 containing internal water reservoirs, two base sections 70, including one having an internal sewage reservoir, and three gable panels 130. The kit 1000 further comprises a plurality of rods 1008 for connecting the outer wall sections 20, base sections 70 and roof sections 90, and further includes a showerhead 30, a toilet 32 and a sink with faucet 34, as well as fluid connection tubing 35. Instructions 1010 for assembly of the first exemplary building 10 are also included in the kit 1000.

Figure 28:
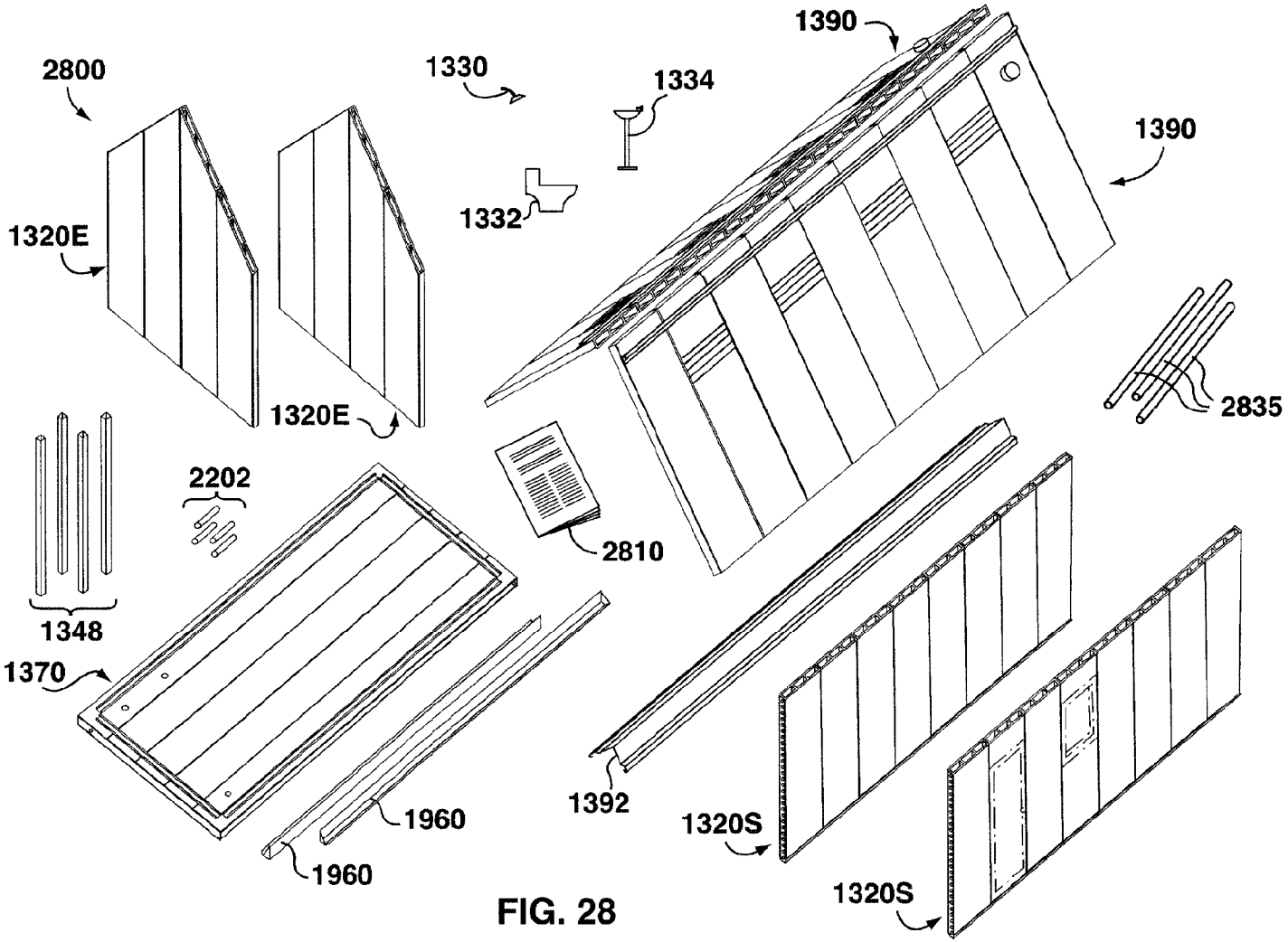
FIG. 28 shows a kit for assembling the building of FIG. 22.

FIG. 28 shows a kit 2800 for constructing the second exemplary building 1310. The kit 2800 comprises two outer end wall sections 1320E, two outer side wall sections 1320S, a base section 1370 having an internal sewage reservoir, two roof sections 1390 having internal water reservoirs, two roof cradle members 1960, a hat member 1392, four corner posts 1348 and four roof posts 2202. The kit 2800 further includes a showerhead 1330, a toilet 1332 and a sink with faucet 1334, as well as fluid connection tubing 1335, along with instructions 1310 for assembly of the second exemplary building 1310.

Figure 29:
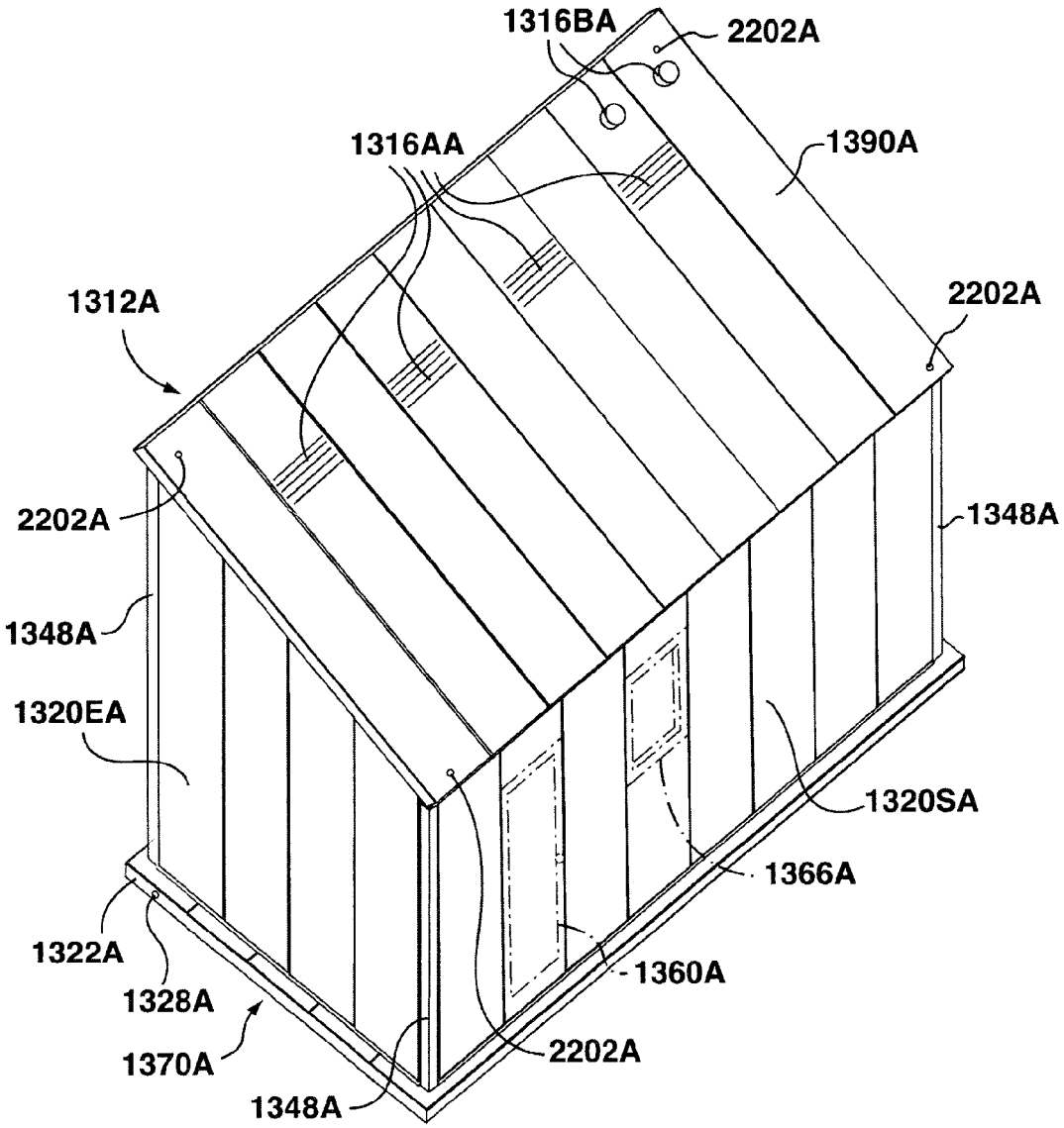
FIG. 29 is a perspective view of a third exemplary building according to an aspect of the present invention.

While modular buildings having a general A-frame structure have been illustrated, the present invention is not limited to buildings having that structure. FIG. 29 shows a third building 1310A assembled analogously to the second building 1310 but having a sloping roof 1312A formed from a single roof section 1390A instead of an A-frame structure. Corresponding reference numerals are used to refer to elements of the third building 1310A that correspond to elements of the second building 1310, but with the suffix "A".

The connectors 1114F, 1114M, 1414M, 1614F, 2014M, 2014F, 2414M, 2414F are exemplary only, and it will be appreciated that the relative positioning of the male and female connectors may be reversed, and that other suitable connectors of various types and shapes may be used without departing from the scope of the present invention. For example, identical cooperating connectors, rather than male and female connectors, may be used.

Dimensions described herein are exemplary only. Several currently preferred embodiments have been described by way of example. It will be apparent to persons skilled in the art that a number of variations and modifications can be made without departing from the scope of the invention as defined in the claims.

What is claimed is:

1. A building envelope section for a modular building, comprising:

plurality of hollow structural members for forming a main body of the building envelope section;

each of the structural members having:

two opposed faces;

two opposed outer edges extending between the faces; the outer edges permitting fluid passage therepast;

at least one reinforcement extending between the faces and disposed between the outer edges; and the at least one reinforcement permitting fluid passage therepast;

wherein, for each structural member:

one outer edge has a set of opposed male connectors extending along a length of the structural member;

each set of male connectors comprising a pair of opposed elongate L-shaped elements comprising leg portions extending inwardly toward one another and stem portions spacing the leg portions from the one outer edge;

the opposite outer edge has a set of correspondingly positioned female connectors also extending along the length of the structural member;

each set of female connectors comprising a pair of opposed elongate L-shaped elements comprising leg portions extending outwardly away from one another and stem portions spacing the leg portions from the opposite outer edge;

the male connectors of each structural member interfitting with the female connectors of each other structural member by:

the leg portions of the female connectors fitting between the leg portions of the male connectors and the one outer edge; and the leg portions of the male connectors fitting between the leg portions of the female connectors and the opposite outer edge;

each structural member being connected to an adjacent structural member in edge-to-edge relation therewith to form the main body of the building envelope section;

each structural member being in fluid communication with each adjacent structural member so that the structural members cooperate to define an internal reservoir within the main body of the building envelope section;

the internal reservoir permitting fluid flow between adjacent structural members;

the internal reservoir having at least one inlet aperture and at least one outlet aperture and being otherwise sealed.

2. The building envelope section of claim 1, wherein each structural member is connected to each adjacent structural member by inserting the male connectors of one structural member into the female connectors of an adjacent structural member and sliding one structural member along the other in a lengthwise direction along the lengths of the respective structural members.

3. The building envelope section of claim 1, wherein the building envelope section is a roof section.

4. The building envelope section of claim 1, wherein the building envelope section is a base section.

* * * * *